US007699035B1

(12) United States Patent
Havlik et al.

(10) Patent No.: US 7,699,035 B1
(45) Date of Patent: Apr. 20, 2010

(54) COMPRESSION RELEASE MECHANISM

(75) Inventors: James Havlik, Viola, WI (US); Kyle Mahan, Palmyra, WI (US); Randy Williams, Viola, WI (US); Jeffrey Bailey, Westby, WI (US); Roy Meyer, Richland Center, WI (US)

(73) Assignee: S & S Cycle, Inc., Viola, WI (US)

( * ) Notice: Subject to any disclaimer, the term of this patent is extended or adjusted under 35 U.S.C. 154(b) by 0 days.

(21) Appl. No.: 12/285,084

(22) Filed: Sep. 29, 2008

(51) Int. Cl.
*F01L 13/08* (2006.01)

(52) U.S. Cl. ..... 123/182.1; 123/90.15

(58) Field of Classification Search ... 123/90.15–90.17, 123/182.1
See application file for complete search history.

(56) References Cited

U.S. PATENT DOCUMENTS 4,453,507 A 6/1984 Braun et al.
4,615,312 A 10/1986 Tsumiyama
4,790,271 A 12/1988 Onda
5,065,720 A * 11/1991 Nishiyama et al. ..... 123/363
5,687,683 A * 11/1997 Knoblauch ..... 123/182.1
6,374,792 B1 * 4/2002 Suzuki et al. ..... 123/182.1
6,557,510 B2 5/2003 Sjovall et al.
6,755,168 B2 * 6/2004 Schneider et al. ..... 123/182.1
7,137,375 B2 * 11/2006 Maeda et al. ..... 123/182.1

FOREIGN PATENT DOCUMENTS

WO WO 2006/083350 8/2006

* cited by examiner

*Primary Examiner*—Erick Solis
(74) *Attorney, Agent, or Firm*—Price, Heneveld, Cooper, DeWitt & Litton, LLP

(57) ABSTRACT

A compression release assembly is disclosed, the assembly including a camshaft rotatable about a camshaft axis, a trigger rotatable about a trigger axis substantially perpendicular to the camshaft axis, and a spring position between the trigger and the camshaft. Preferably, the trigger is rotated from an engagement position toward a disengagement position when a rotational velocity of the camshaft achieves a known value, and is rotated from the disengagement position toward the engagement position when the rotational velocity of the camshaft is below the known value.

23 Claims, 38 Drawing Sheets

COMPRESSION RELEASE MECHANISM

FIELD OF THE INVENTION

This invention relates generally to compression release mechanisms and more particularly to compression release mechanisms preferably used in motorcycle engines.

DESCRIPTION OF THE RELATED ART

Compression release mechanisms have been used to reduce undesirable forces associated with the operation of an engine, such as forces resisting the starting of an internal combustion engine. Exemplary compression release mechanisms are described, for example, in U.S. Pat. Nos. 4,790,271; 4,615,312; and 4,453,507, which are incorporated by reference herein in their entirety. Known compression release mechanisms, however, suffer from various problems.

In one exemplary design, a loosely fitting ring is utilized with a decompression lobe mounted on the camshaft. The ring is held from rotating by two pins and a spring mounted on the camshaft. At starting speeds, the ring will partially rotate until it is lifted onto one of the pins on the camshaft. At this point, the cam follower will ride up the decompression lobe, causing a valve to open and partially relieve cranking compression. After startup the ring gets pulled out by rotational forces for normal engine operation.

One problem with the above referenced design relates to the loose fit of the ring. In particular, because the ring fits loosely on the camshaft, the ring tends to be very unsteady at low and rough idling speeds of some internal combustion engines. The unsteadiness, in turn, can cause erratic engagement in a running internal combustion engine. One of skill in the art would appreciate the undesirableness of such erratic engagement.

Another problem with the above referenced design relates to the robustness of the assembly. In particular, the design relies on the use of small pins to hold it in place during the decompression mode. One of skill in the art would appreciate that, at least with respect to internal combustion engines with high valve spring forces, the use of small pins would not be robust enough to handle the high spring force.

A need thus exists for an improved compression release mechanism that addresses one or more of the above referenced problems, or other problems relating to known compression release mechanisms.

SUMMARY OF THE INVENTION

In one aspect of the present invention, a compression release assembly includes a camshaft rotatable about a camshaft axis and including a camshaft lobe and a trigger rotatably mounted on the camshaft about a trigger axis, the trigger axis being substantially perpendicular to the camshaft axis and intersecting the trigger between first and second distal ends of the trigger. The trigger includes a compression release lobe formed at the first distal end of the trigger proximate to the camshaft lobe; and a counterweight formed at the second distal end of the trigger, the trigger being L shaped and positioning the first and second distal ends on a same side of the camshaft axis. A spring is positioned between the camshaft and the trigger, the spring tending to rotate the trigger about the trigger axis toward an engagement position. By this arrangement, when the camshaft is rotating at or above a sufficient velocity, centripetal forces act on the counterweight overcome spring biasing such that the trigger rotates from the engagement position to a disengagement position.

In another aspect of the present invention, an apparatus comprises an engine including a camshaft rotatable about a camshaft axis and including a camshaft lobe; and a compression release assembly as discussed above.

In another aspect of the present assembly, a method of selectably releasing compression in an engine includes providing a camshaft that defines a camshaft axis; and releasably holding a trigger in an engagement position with a spring, the trigger including a compression release lobe formed at a first distal end of the trigger and a counterweight formed at a second distal end of the trigger and a trigger axis defining with the first and second distal ends an L shaped arrangement so that the first and second ends are on a same side of the camshaft axis when assembled. The method further includes contacting a compression release lobe of the trigger with a lifter when the trigger is in the engagement position; rotating, about the camshaft axis, the trigger at a rotational velocity; rotating about the trigger axis perpendicular to the camshaft axis, the trigger from the engagement position toward a disengagement position when the rotational velocity achieves a known value; contacting a camshaft lobe with the lifter when the trigger is in the disengagement position; and rotating, about the trigger axis, the trigger from the disengagement position toward the engagement position when the rotational velocity is below the known value.

In another aspect of the present invention, a compression release assembly includes means for selectably contacting a compression release lobe of a trigger with a lifter; means for rotating, about a trigger axis perpendicular to a camshaft axis, the trigger from an engagement position toward a disengagement position when a rotational velocity of a camshaft achieves a known value, the trigger being L shaped and including first and second distal ends on a same side of the camshaft axis; and means for rotating, about the trigger axis, the trigger from the disengagement position toward the engagement position when the rotational velocity of the camshaft is below the known value.

In another aspect of the present invention, a compression release assembly comprises a camshaft rotatable about a camshaft axis and including a camshaft lobe and opposing outwardly-facing flat engagement surfaces; and a ring defining an opening with inward-facing mating engagement surfaces slidably engaging the flat engagement surfaces for mounting the ring on the camshaft. The ring includes a counterweight formed at a first distal end of the ring; and a compression release lobe formed at a second distal end of the ring. A spring is positioned between the camshaft and the ring, the spring tending to slide the ring relative to the camshaft into an engagement position. By this arrangement, when the camshaft is rotating at or above a sufficient velocity, centripetal forces acting on the counterweight overcome spring biasing such that the ring slides from the engagement position to a disengagement position.

In another aspect of the present invention, a compression release assembly comprises a camshaft rotatable about a camshaft axis and including a camshaft lobe and a trigger-receiving recess not extending through the camshaft; and a trigger rotatably mounted on the camshaft about a trigger axis, the trigger axis being substantially perpendicular to the camshaft axis and intersecting the trigger between first and second distal ends of the trigger. The trigger includes a compression release lobe formed at the first distal end of the trigger proximate to the camshaft lobe; and a counterweight formed at the second distal end of the trigger. A spring is positioned between the camshaft and the trigger, the spring tending to rotate the trigger about the trigger axis toward an engagement position. By this arrangement, when the camshaft is rotating at or above a sufficient velocity, centripetal forces acting on the counterweight overcome spring biasing such that the trigger rotates from the engagement position to a disengagement position.

DETAILED DESCRIPTION OF THE EXEMPLARY EMBODIMENTS

Figure 1:
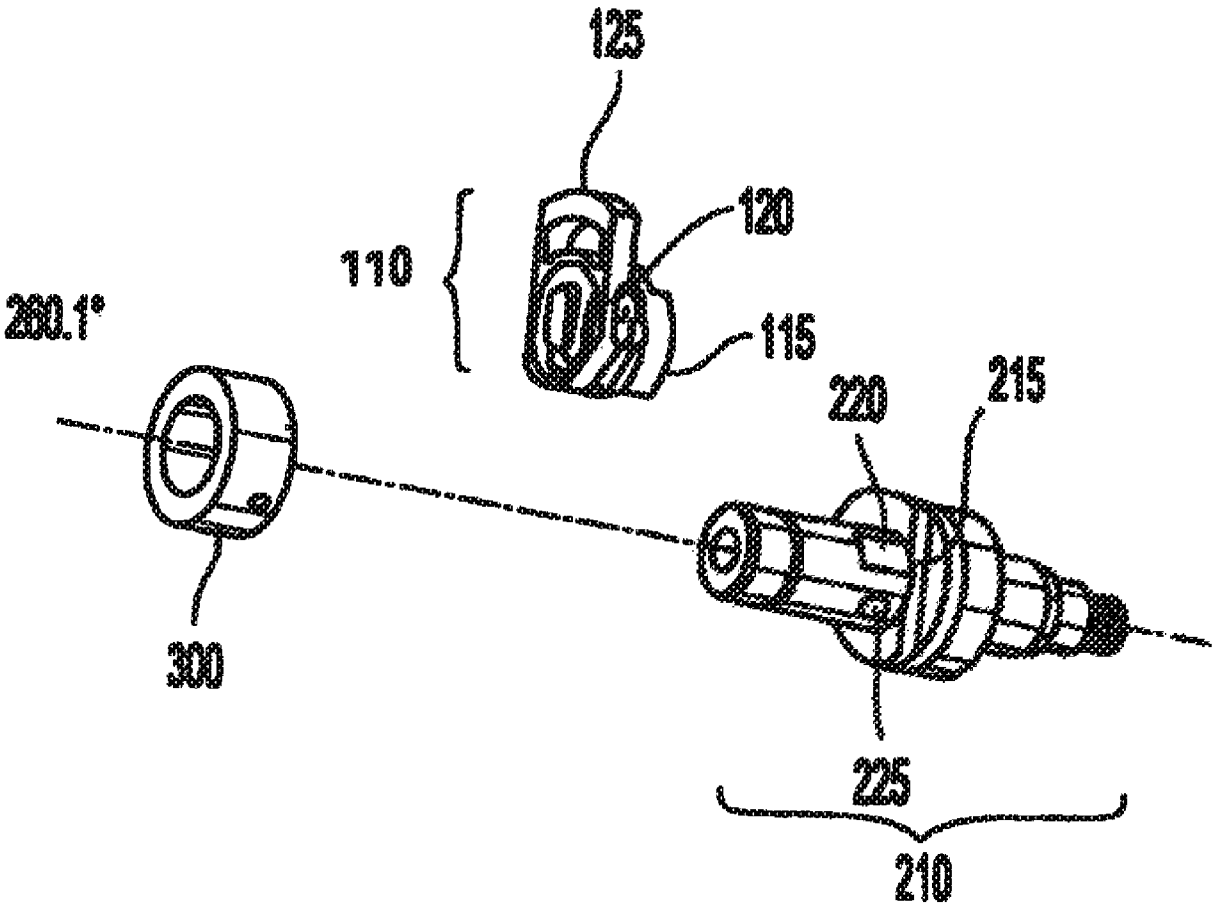
FIG. 1 is an exploded assembly view of a compression release mechanism according to an embodiment of the present invention.
Figure 2:
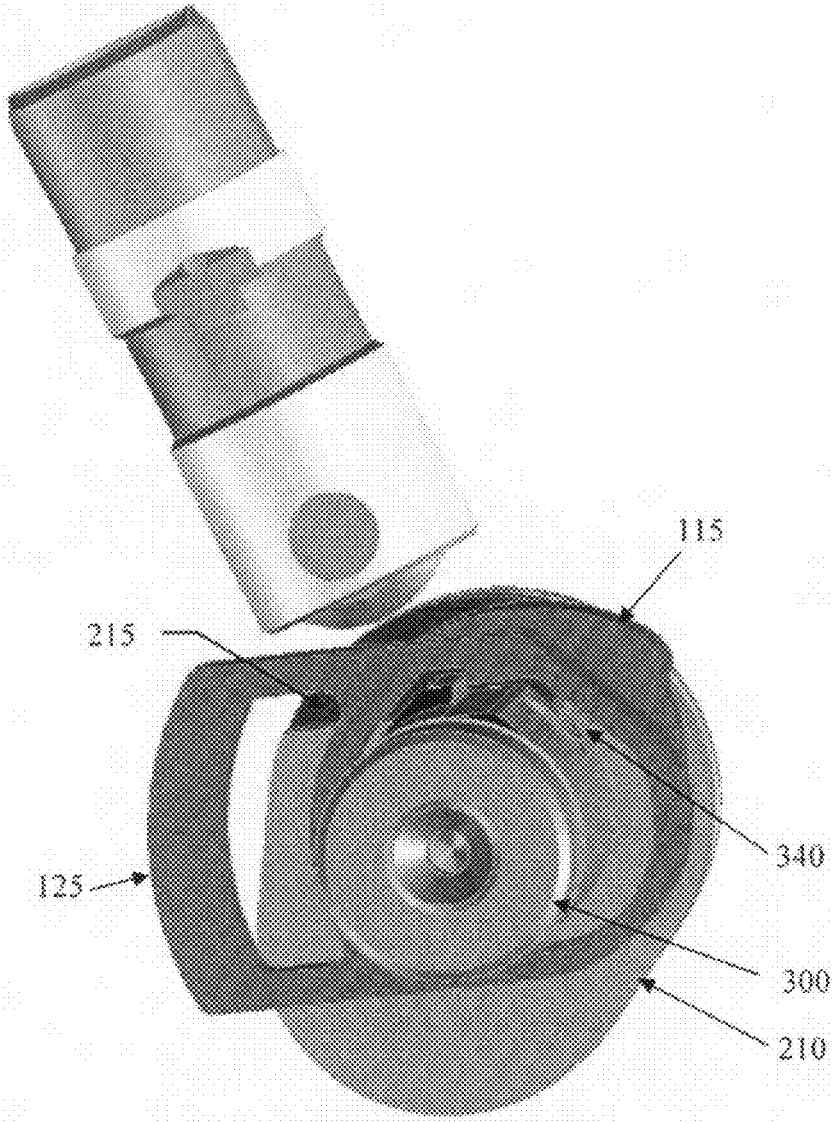
FIG. 2 is a side view of the compression release mechanism of FIG. 1 according to an embodiment of the present invention.

As illustrated in the discussion below, various embodiments of the present invention are directed at a compression release mechanism for use in an internal combustion engine such as a V-twin motorcycle engine. Examples include original equipment manufacturer (OEM) applications and retrofit applications, such as use with Twin Cam® and Sportster® style engines. One exemplary motorcycle engine is described in WO 2006/083350 (Aug. 10, 2006), which is incorporated by reference herein in its entirety. It should be appreciated, however, that one or more of these embodiments may also be used in other applications, such as automotive engines, all terrain vehicle (ATV) engines, personal watercraft and boat engines, snowmobile engines, commercial equipment engines, lawn and garden equipment engines, etc. Thus, the disclosed embodiments should not be construed as being limited solely to motorcycle engine applications. Moreover, one of skill in the art would appreciate that various materials and manufacturing processes can be used for one or more components of the disclosed embodiments. Exemplary materials include billet aluminum and steel (e.g., stainless steel).

Turning now to the embodiments of FIGS. 1-7, the compression release mechanisms shown include a ring 110 detachably positioned on a camshaft 210. The ring 110 includes a counterweight 125, an engagement surface 120, and a compression release lobe 115. The camshaft 210 preferably includes a flat 215 on which the ring 110 is slidably engaged, an engagement surface 220 which engages engagement surface 120 of ring 110, and a pocket 225 which receives a spring 340. In some applications, a removable retaining collar 300 may be provided with or without a set screw for easy assembly/disassembly.

In at least one mode of operation, the ring 110 is positioned on a camshaft 210 such that the ring 110 is held from rotating (relative to the camshaft 210) by preferably two flats 215 (though one flat, or more than two flats could be used) on the camshaft 210. For discussion purposes, two positions will be discussed in detail below: (i) an "engagement position" in which a compression release lobe 115 is positioned so as to engage a valve assembly (e.g., by way of direct contact with a lifter assembly); and (ii) a "disengagement position" in which a compression release lobe 115 is positioned so as to avoid engagement with the valve assembly. The engagement position is shown, for example, in FIG. 7. The disengagement position is shown, for example, in FIG. 6. The ring 110 of the present embodiment is selectively slid (relative to the camshaft 210) between the engagement position and the disengagement position as discussed in greater detail below.

Selective sliding of the ring 110 can be achieved by way of interplay between centripetal forces operating on counterweight 125 (when rotating) and spring forces operating on spring engagement surfaces of ring 110/camshaft 210 (at all times). In particular, at all RPMs the spring 340 provides a relative force between the ring 110 and the camshaft 210 tending to cause sliding of the ring 110 into the engaged position and to hold the ring 110 therein. However, as the rotational velocity of the camshaft 210 gradually increases, the centripetal forces acting on counterweight 125 similarly gradually increase. These centripetal forces tend to cause a sliding of ring 110 opposite the sliding caused by spring 340. At some known rotational velocity (and at rotational velocities above this known value) that depends on spring 340 parameters and ring 110 parameters, the force on ring 110 caused by centripetal forces acting on counterweight 125 exceeds the force caused by spring 340. Thus, the ring 110 slides from the engagement position toward the disengagement position. When the rotational velocity falls below the known value (e.g., when the engine is turned off), the force caused by spring 340 again exceeds the forces caused by centripetal forces acting on counterweight 125, and the ring 110 slides back toward the engagement position from the disengagement position. In this manner, the ring 110 is selectively slid between the engagement position and the disengagement position.

Figure 3:
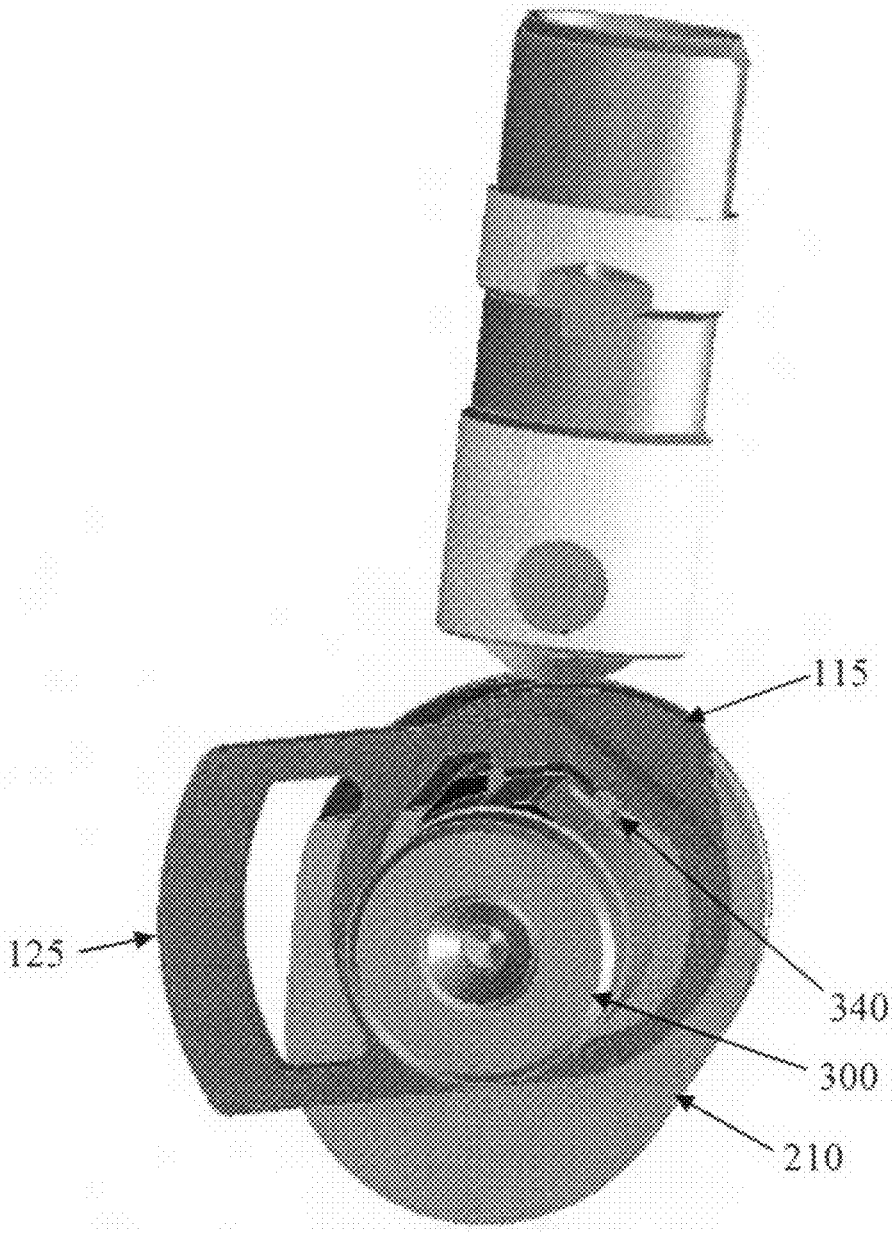
FIG. 3 is a side view of the compression release mechanism of FIG. 1 according to another embodiment of the present invention.
Figure 4:
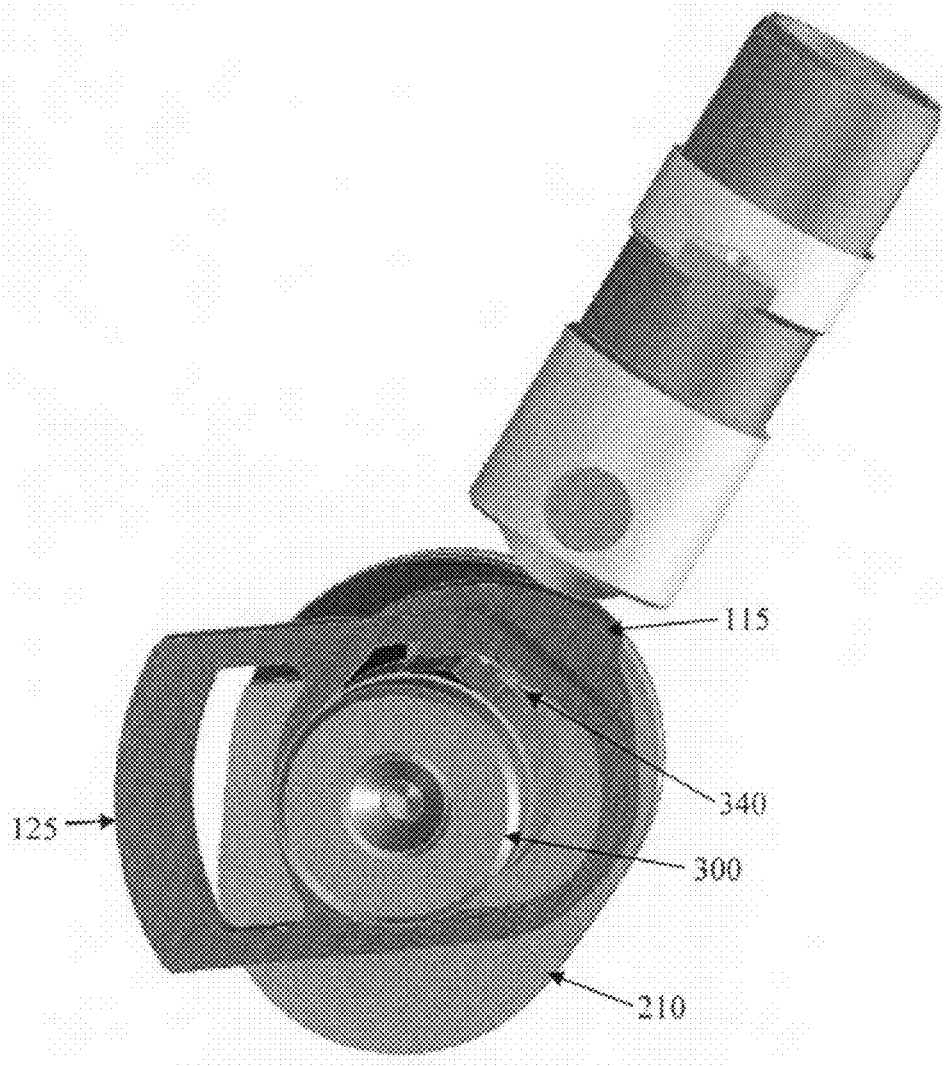
FIG. 4 is a side view of the compression release mechanism of FIG. 1 according to another embodiment of the present invention.
Figure 5:
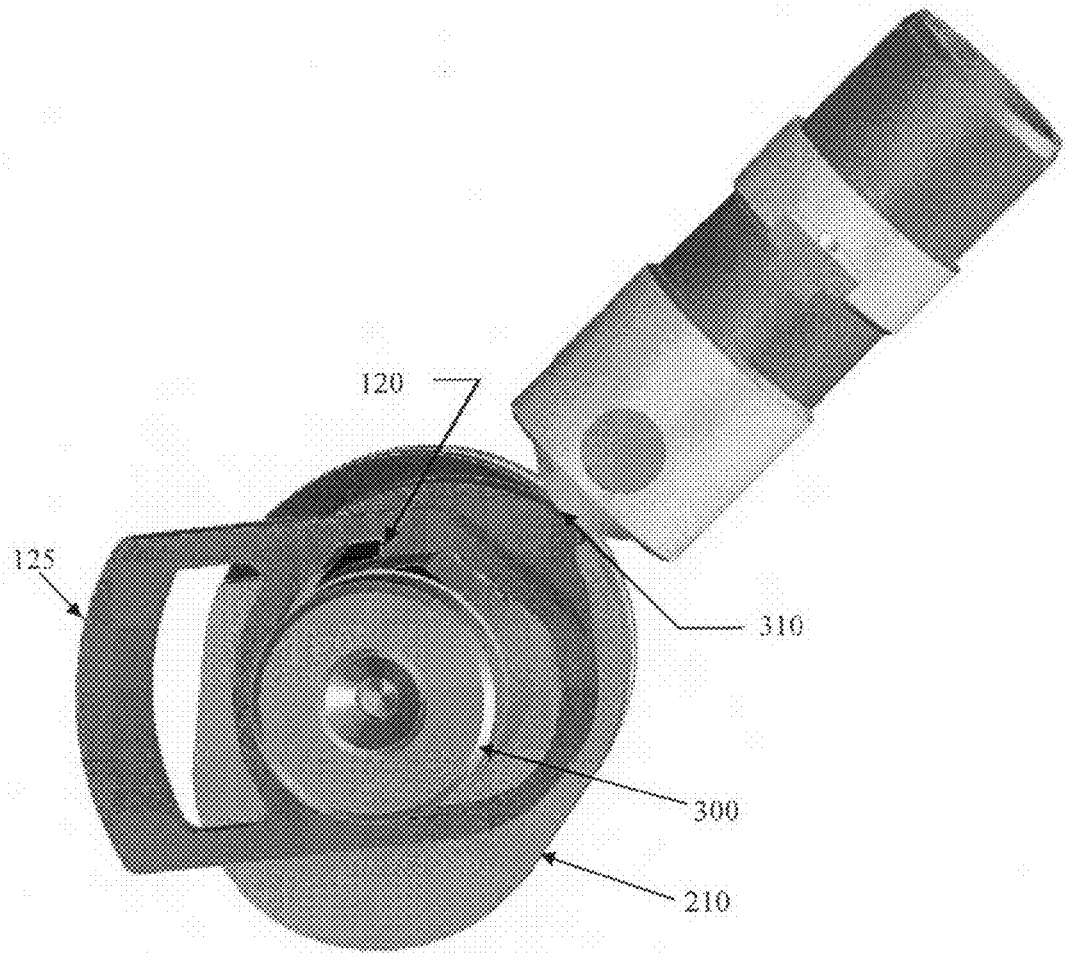
FIG. 5 is a side view of the compression release mechanism of FIG. 1 according to another embodiment of the present invention.
Figure 6:
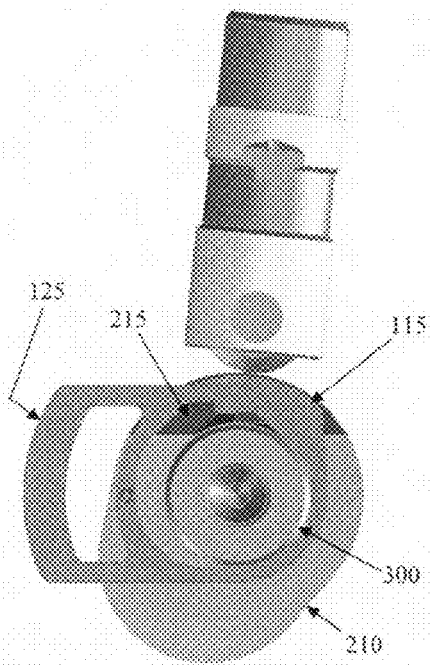
FIG. 6 is a side view of a camshaft with the compression release mechanism of FIG. 1 in a disengagement position according to an embodiment of the present invention.
Figure 7:
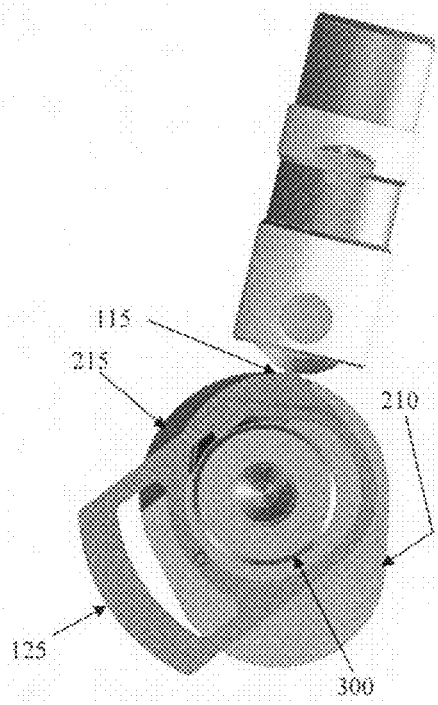
FIG. 7 is a side view of the camshaft and compression release mechanism of FIG. 6 with the compression release mechanism in an engagement position according to an embodiment of the present invention.
Figure 8:
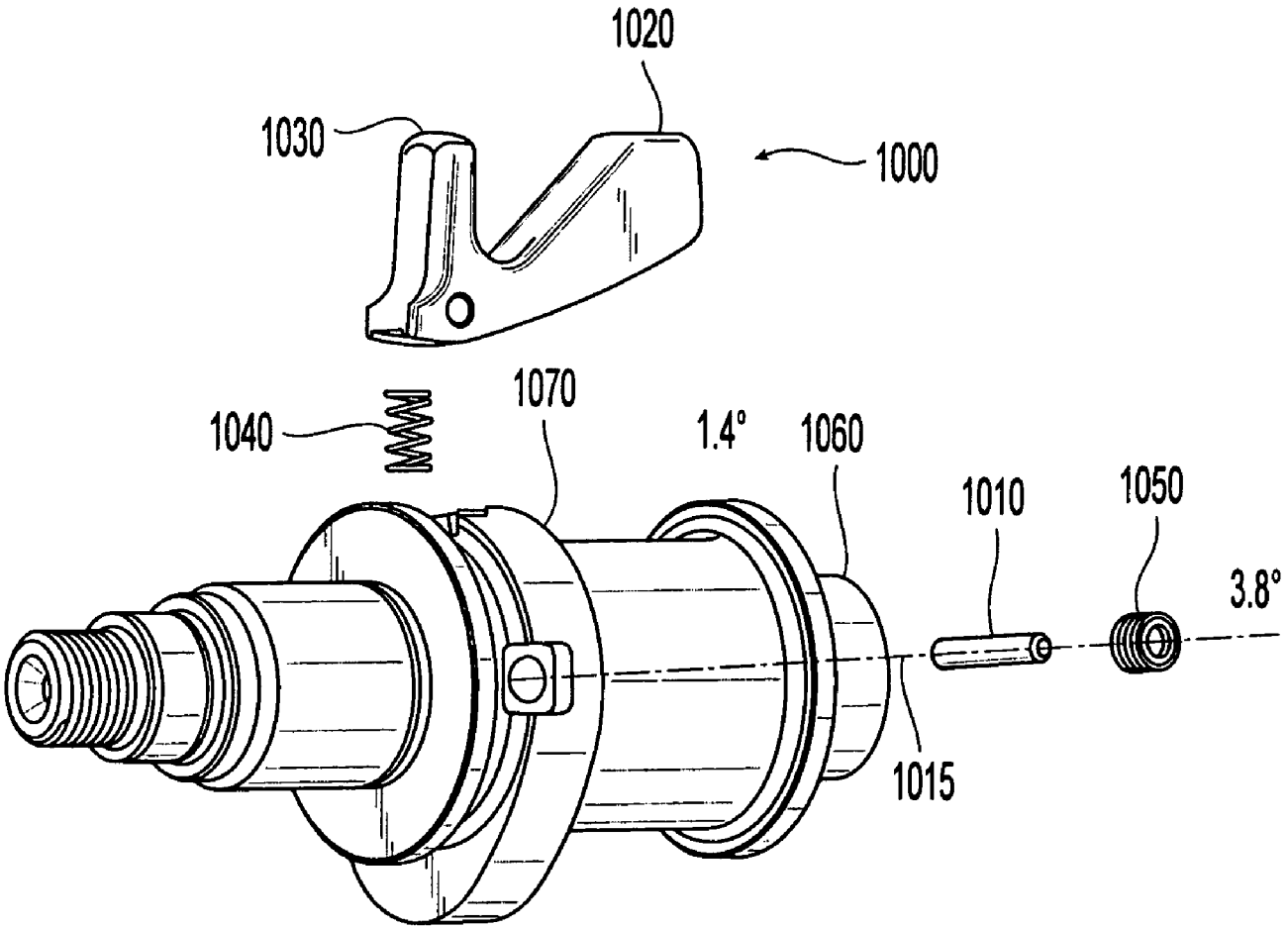
FIG. 8 is an exploded assembly view of a compression release mechanism usable with a front exhaust camshaft according to another embodiment of the present invention.
Figure 9:
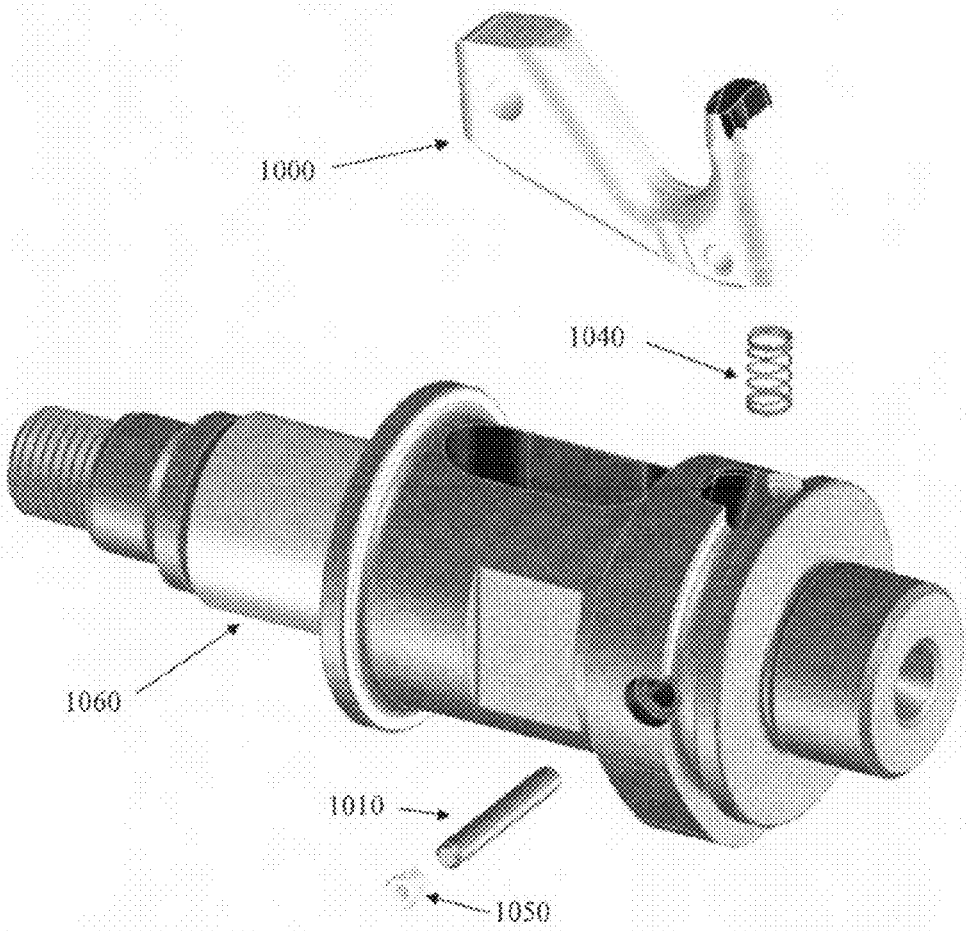
FIG. 9 is an exploded assembly view of a compression release mechanism usable with a rear exhaust camshaft according to another embodiment of the present invention.

The operation of ring 110 relative to camshaft 210 can also be observed by reference to FIGS. 3-5. As the lifter follows the base circle, it catches a lobe 115 protruding from the ring 110. This slides the ring 110 along the flat 215 on the cam lobe. As the camshaft 210 continues to rotate, the lifter rides along the lobe 115 and pushes the spring loaded ring 110 down such that an engagement surface 120 of the ring 110 engages a corresponding engagement surface 220 of camshaft 210. See, for example, contact point 310 in FIG. 5 where the lifter assembly contacts the lobe 115. Now locked in place, the lobe 115 forces the lifter up slightly at the lobe 115, causing the exhaust valve to crack open during the compression stroke, relieving a certain amount of cylinder pressure. The exhaust valve then returns closed, allowing the engine to start with much less cranking compression. When the engine starts, increased rotational speed generates enough rotational force to cause a counterweight 125 on the ring 110 to act against a spring 340 in a pocket 225 of camshaft 210 and stay in the disengaged position for normal engine operation.

Figure 10:
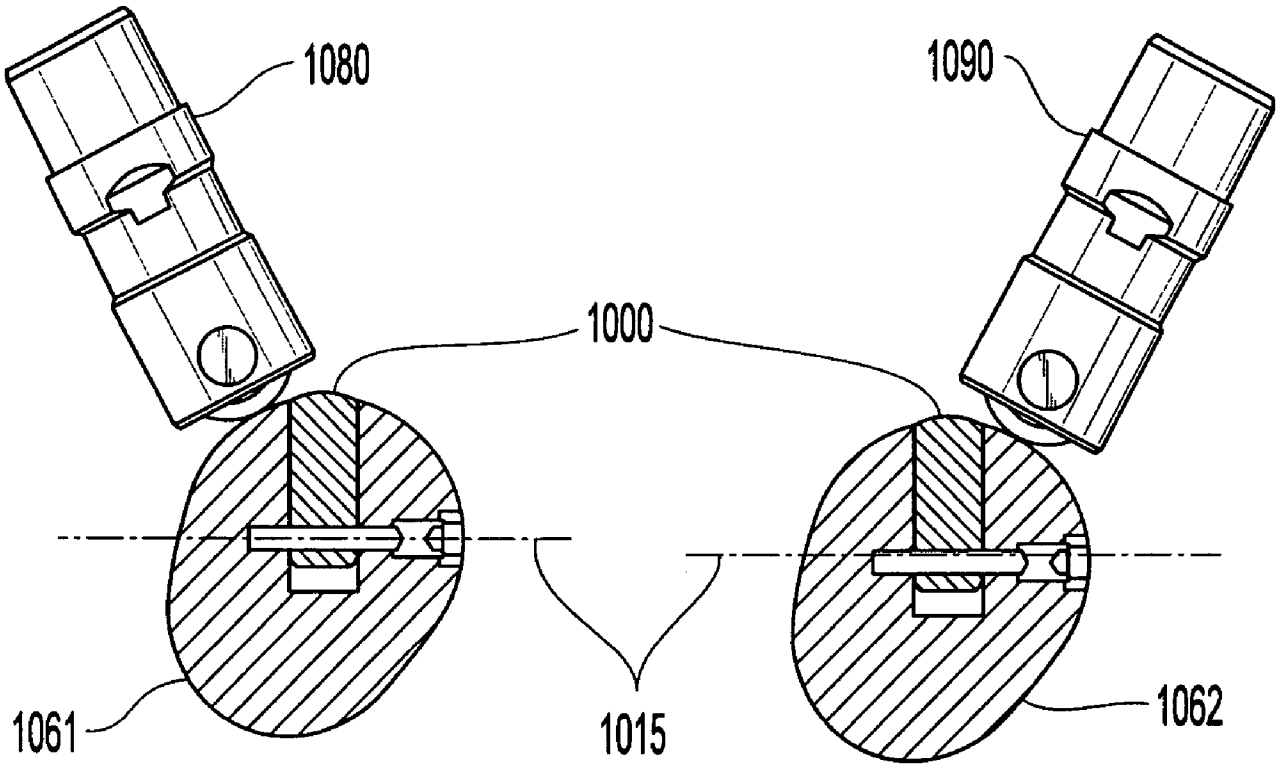
FIG. 10 is a cross sectional view of a rear exhaust camshaft and a front exhaust camshaft with associated lifter assemblies and associated triggers according to an embodiment of the present invention.
Figure 12:
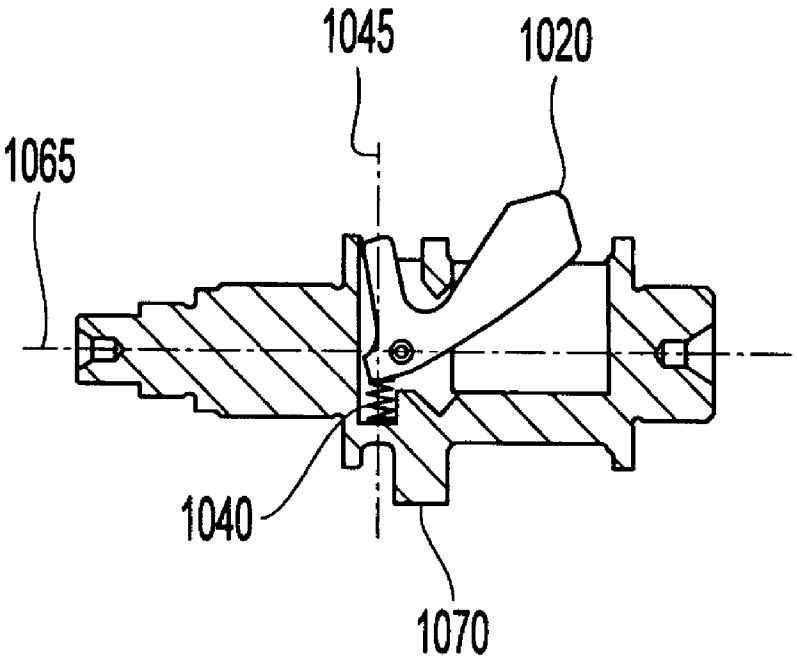
FIG. 12 is a cross sectional view of the camshaft of FIG. 11 with the trigger of FIG. 11 in a disengagement position according to an embodiment of the present invention.
Figure 11:
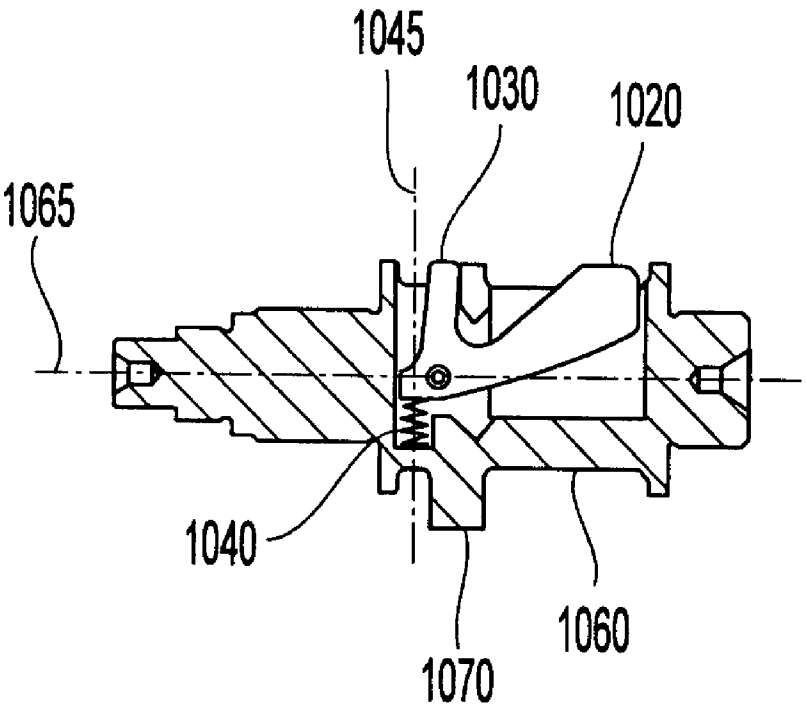
FIG. 11 is a cross sectional view of a camshaft with a trigger in an engagement position as may be used with a front exhaust camshaft according to an embodiment of the present invention.

Turning next to the embodiments of FIGS. 8-30, the compression release mechanisms shown include a camshaft 1060 rotatable about a camshaft axis 1065, a trigger 1000 rotatable about a trigger axis 1015 that is substantially perpendicular to camshaft axis 1065, and a spring 1040 positioned between the camshaft 1060 and the trigger 1000 (the spring preferably being aligned along a spring axis 1045 shown best in FIGS. 11 and 12). In the embodiment shown in FIGS. 11 and 12, the axes 1015 and 1065 intersect. However, axes 1015 and 1065 may be offset in some applications. Preferably, the camshaft 1060 includes a camshaft lobe 1070 with an obround shape relative to the camshaft axis 1065, and a first spring engagement surface for engaging spring 1040. The trigger 1000 preferably includes a compression release lobe 1030 formed at a first distal end of the trigger 1000 proximate to the camshaft lobe 1070, a counterweight 1020 formed at a second distal end of the trigger 1000, and a second spring engagement surface for engaging spring 1040. The trigger 1000 may be rotatably coupled to the camshaft 1060 by a pin 1010 and associated nut 1050 or by other suitable fastener techniques.

As shown for example in FIG. 10, the compression release mechanism can be used in a variety of applications. Shown on the left of FIG. 10 is a trigger 1000 positioned with an associated a rear exhaust camshaft 1061 (a cross section thereof is depicted) that actuates a lifter assembly 1080 for the rear exhaust valve of a twin cylinder motorcycle engine. Shown on the right of FIG. 10 is a trigger 1000 positioned with an associated front exhaust camshaft 1062 (a cross section thereof is depicted) that actuates a lifter assembly 1090 for the front exhaust valve of the twin cylinder motorcycle engine. The camshafts 1061, 1062 shown rotate in a clockwise direction about associated camshaft axes. The triggers 1000 rotate about trigger axes 1015 substantially perpendicular to the associated camshaft axes 1065, and as part of the complete compression release mechanisms that rotate about the camshaft axes 1065 in response to rotation of the associated camshafts 1061, 1062.

Figure 13:
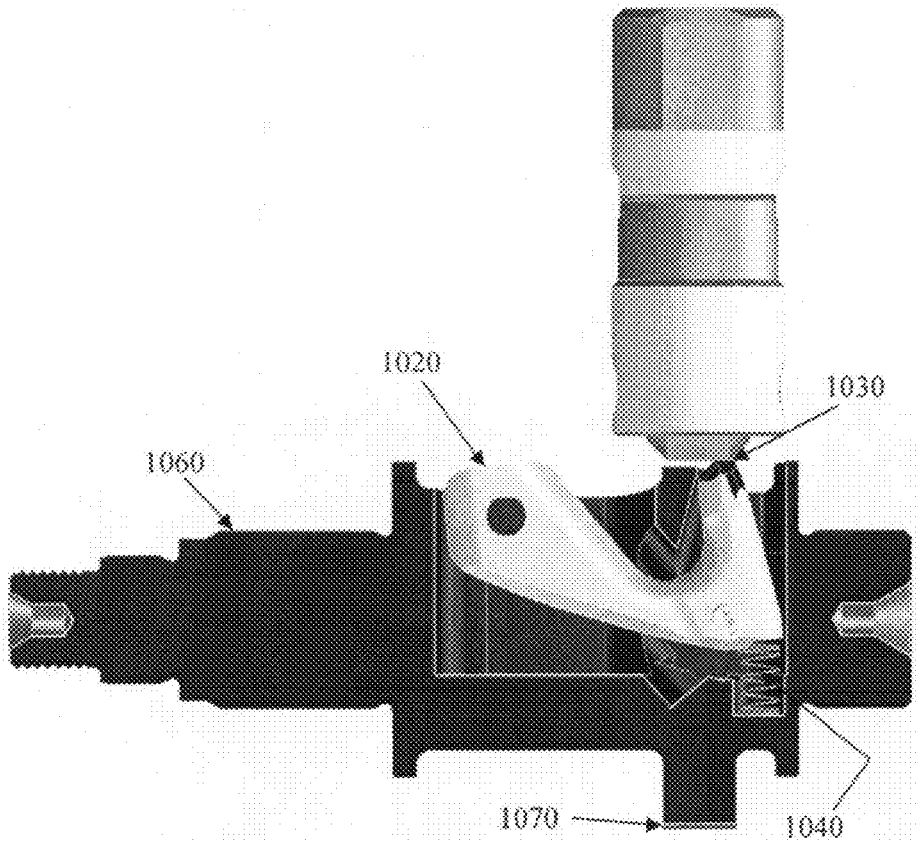
FIG. 13 is a cross sectional view of a camshaft with a trigger in an engagement position as may be used with a rear exhaust camshaft according to an embodiment of the present invention.
Figure 14:
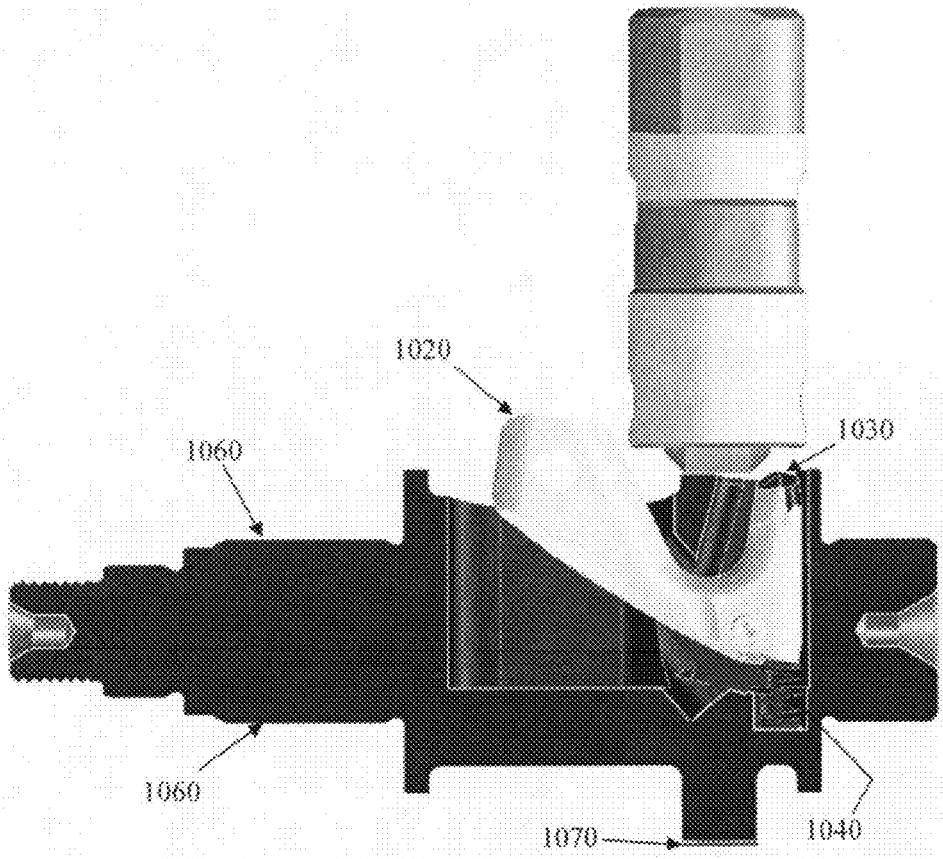
FIG. 14 is a cross sectional view of the camshaft of FIG. 13 with the trigger of FIG. 13 in a disengagement position according to an embodiment of the present invention.
Figure 15:
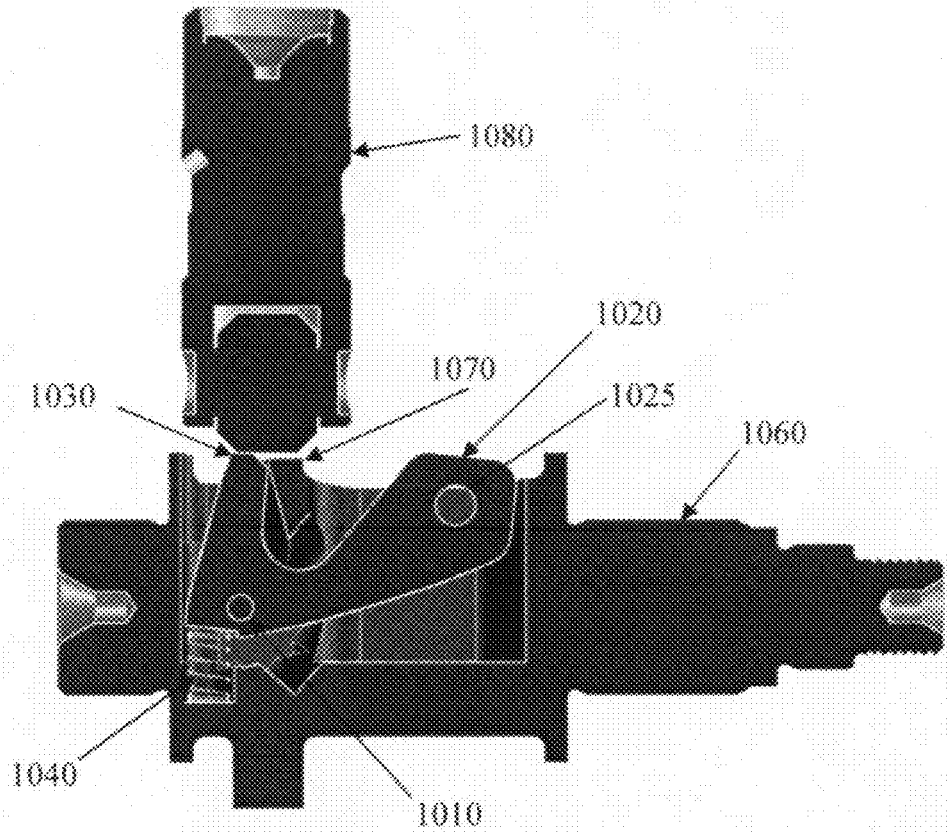
FIG. 15 is a cross sectional view of the camshaft of FIG. 13 from the opposite side, including a cross sectional view of the trigger shown in FIG. 13.

In at least one mode of operation, the compression release mechanism described above is configured to selectively contact a lifter assembly 1080, 1090 with a compression release lobe 1030 of trigger 1000. Namely, the compression release lobe 1030 of a given trigger 1000 is selectively rotated into and out of a lifter roller path of travel so as to selectively contact an associated lifter assembly 1080, 1090. For discussion purposes, two positions will be discussed in detail below: (i) an "engagement position" in which a compression release lobe 1030 is positioned so as to engage a valve assembly (e.g., by way of direct contact with a lifter assembly 1080, 1090); and (ii) a "disengagement position" in which a compression release lobe 1030 is positioned so as to avoid engagement with the valve assembly. FIGS. 11 and 13 show an exemplary trigger 1000 and camshaft 1060 with a trigger 1000 oriented in an engagement position. FIGS. 12 and 14 show the same exemplary trigger 1000 and camshaft 1060 of FIGS. 11 and 13 respectively with the trigger 1000 oriented in a disengagement position. The trigger 1000 selectively rotates between the engagement position of FIGS. 11 and 13 and the disengagement position of FIGS. 12 and 14 so as to selectively engage the associated lifter assembly 1080, 1090.

Selective rotation of the trigger 1000 can be achieved by way of interplay between centripetal forces operating on counterweight 1020 (when rotating) and spring forces operating on spring engagement surfaces of trigger 1000/camshaft 1060 (at all times). In particular, at all RPMs the spring 1040 provides a relative force between the trigger 1000 and the camshaft 1060 tending to cause rotation of the trigger 1000 into the engaged position and to hold the trigger 1000 therein. For example, referring to FIG. 15, the spring 1040 tends to cause clockwise rotation of trigger 1000 about pin 1010 based on the spring 1040's application of a relative force between camshaft 1060 and trigger 1000. However, as the rotational velocity of the camshaft 1060 gradually increases, the centripetal forces acting on counterweight 1020 similarly gradually increase. These centripetal forces tend to cause a rotation of trigger 1000 opposite the rotation caused by spring 1040 (and, in some applications, opposite the rotation caused by gravity with or without assistance by spring 1040). Referring again to FIG. 15, the centripetal forces acting on counterweight 1020 will tend to cause counterclockwise rotation of trigger 1000 about pin 1010. At some known rotational velocity (and at rotational velocities above this known value) that depends on spring 140 parameters and trigger 1000 parameters, the torque on trigger 1000 caused by centripetal forces acting on counterweight 1020 exceeds the torque caused by spring forces from spring 1040. Thus, the trigger 1000 rotates from the engagement position toward the disengagement position (i.e., from the orientation shown in FIG. 11 to the orientation shown in FIG. 12). When the rotational velocity falls below the known value (e.g., when the engine is turned off), the torque caused by spring forces from spring 1040 again exceeds the torque caused by centripetal forces acting on counterweight 1020, and the trigger 1000 rotates back toward the engagement position from the disengagement position (i.e., from the orientation shown in FIG. 12 to the orientation shown in FIG. 11). In this manner, the trigger 1000 is selectively rotated between the engagement position and the disengagement position.

Preferably, the compression release lobe 1030 of trigger 1000 and/or the camshaft lobe 1070 of camshaft 1060 are configured to have peripheries that enhance operation of the compression release mechanism. For example, as shown in FIGS. 25-30, the compression release lobe 1030 may include a lifter roller engagement surface (i.e., the surface that comes into contact with lifter assembly 1080, 1090) arced between a first end and a second end, both the first end and the second end being at about a same fixed distance from the trigger axis 1015. Preferably, when the trigger 1000 is positioned in the engagement position, the lifter roller engagement surface arcs about the camshaft axis 1065. See, for example, FIG. 24. Such an orientation allows the lifter assembly 1080, 1090 to travel an arced path while in contact with the lifter roller engagement surface. See, for example, FIG. 30 The compression release lobe 1030 of trigger 1000 may also include beveled edges extending along at least a portion of the lifter roller engagement surface. Preferably, the compression release lobe 1030 of trigger 1000 at least includes beveled edges on those edges extending between the first end and the second end of the engagement surface described above.

Figure 16:
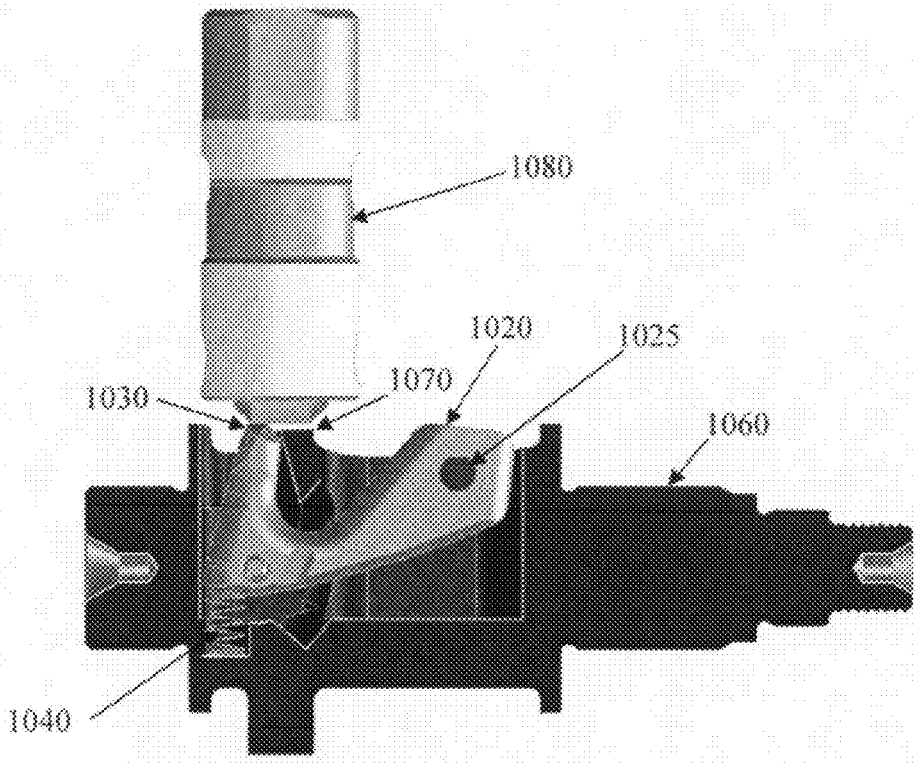
FIG. 16 is a cross sectional view of the camshaft of FIG. 13 from the opposite side.
Figure 17:
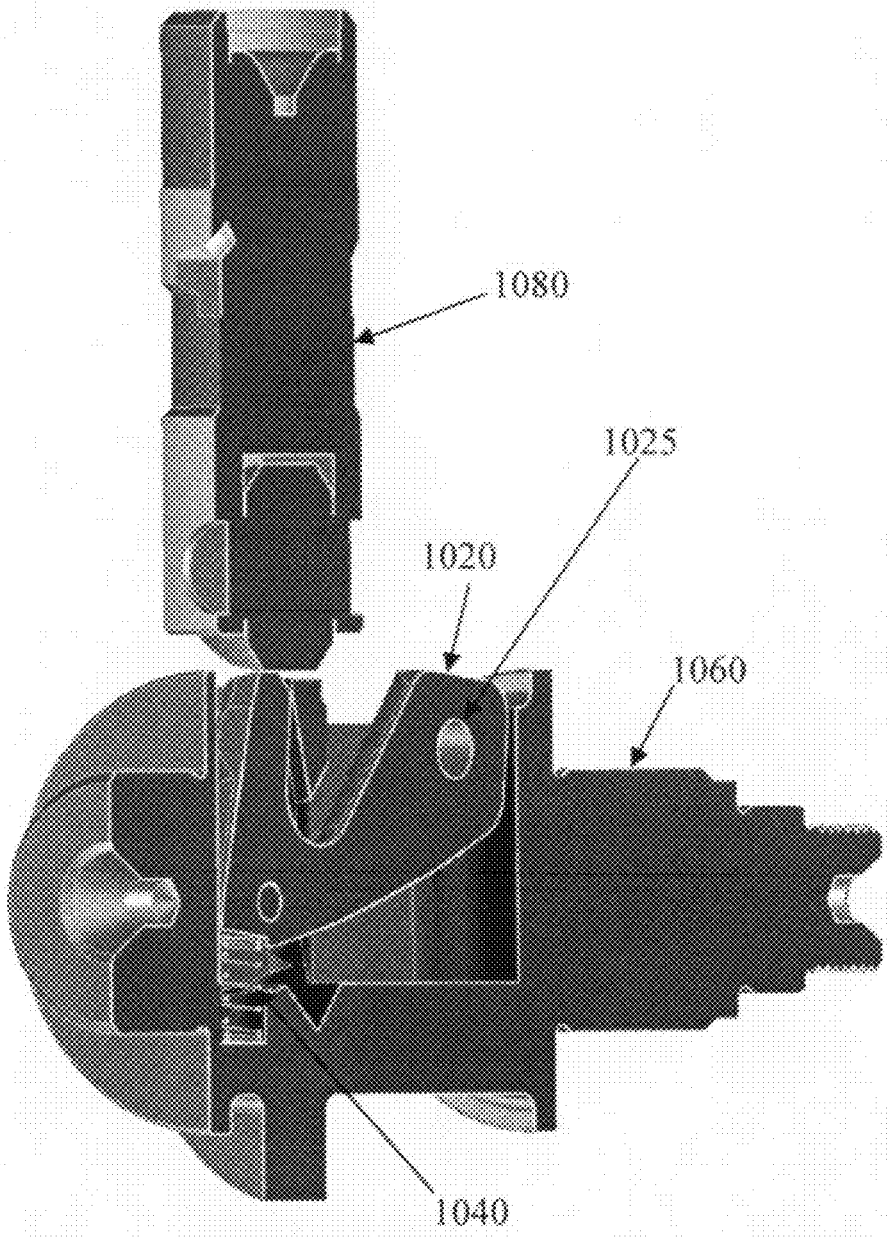
FIG. 17 depicts the cross sectional view of FIG. 15 rotated partially about a spring axis.
Figure 18:
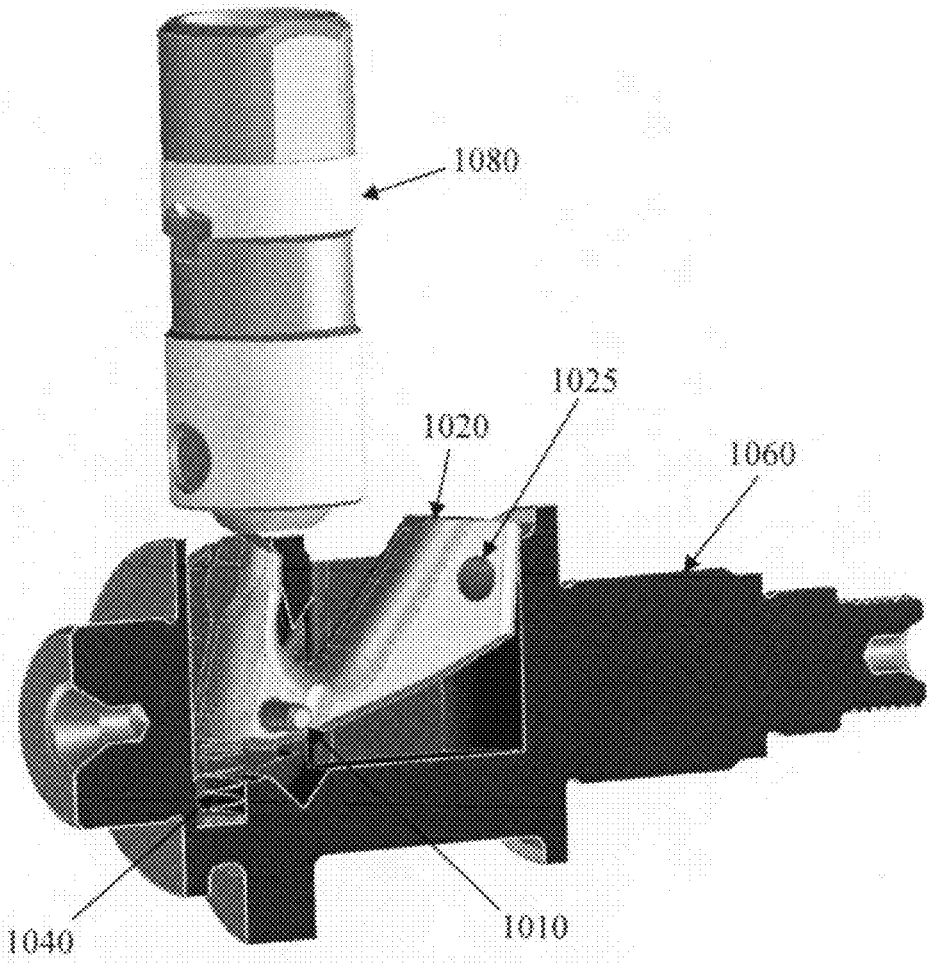
FIG. 18 depicts the cross sectional view of FIG. 16 rotated partially about a spring axis.
Figure 19:
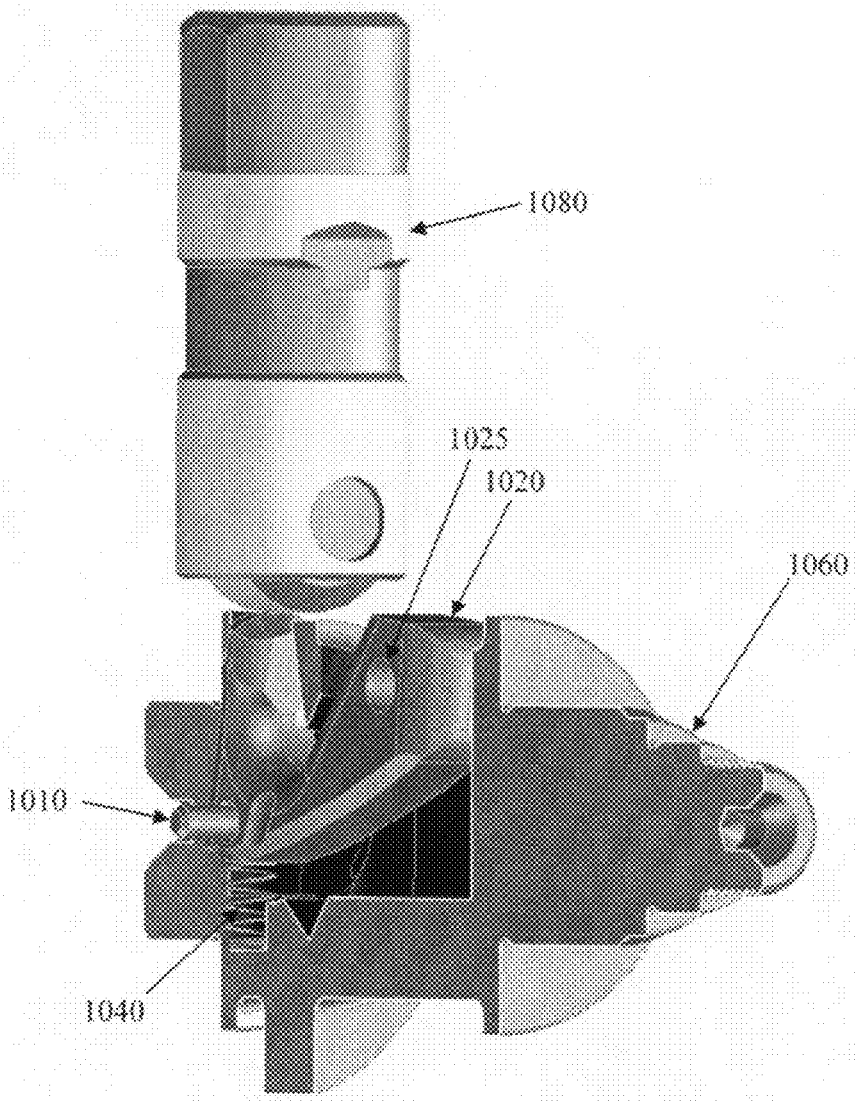
FIG. 19 depicts the cross sectional view of FIG. 16 rotated partially about a spring axis.
Figure 20:
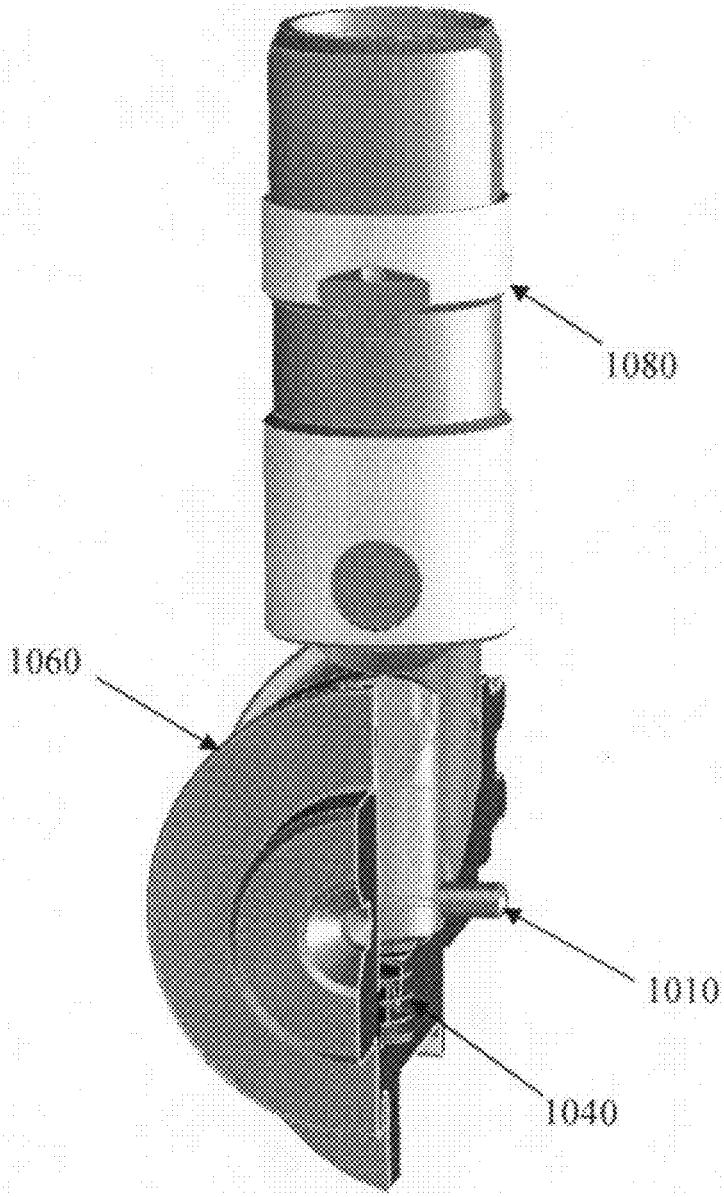
FIG. 20 depicts the cross sectional view of FIG. 16 rotated partially about a spring axis.
Figure 21:
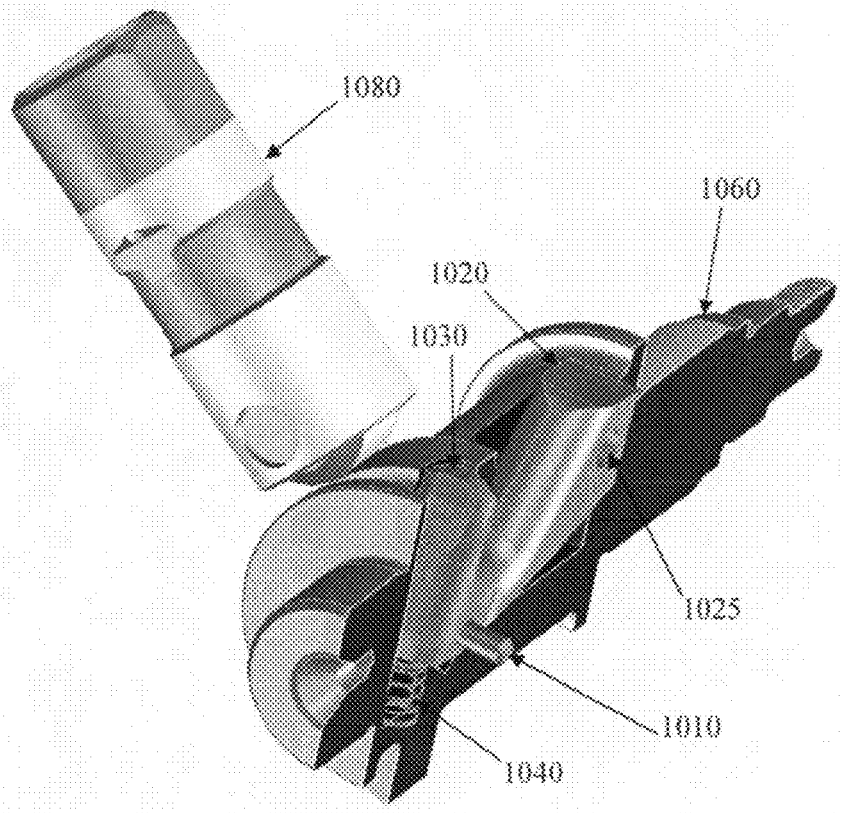
FIG. 21 depicts the cross sectional view of FIG. 16 rotated partially about a spring axis and partially about a camshaft axis.
Figure 22:
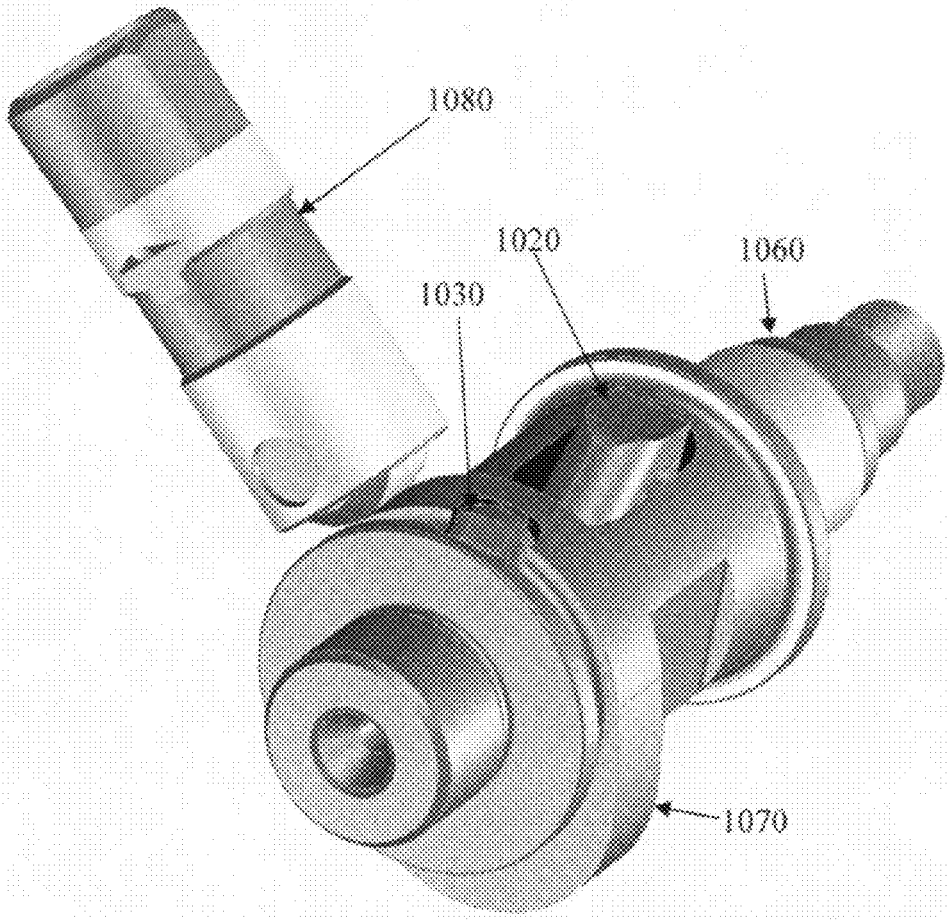
FIG. 22 depicts a perspective view of a camshaft, a compression release mechanism, and a lifter assembly according to an embodiment of the present invention.
Figure 23:
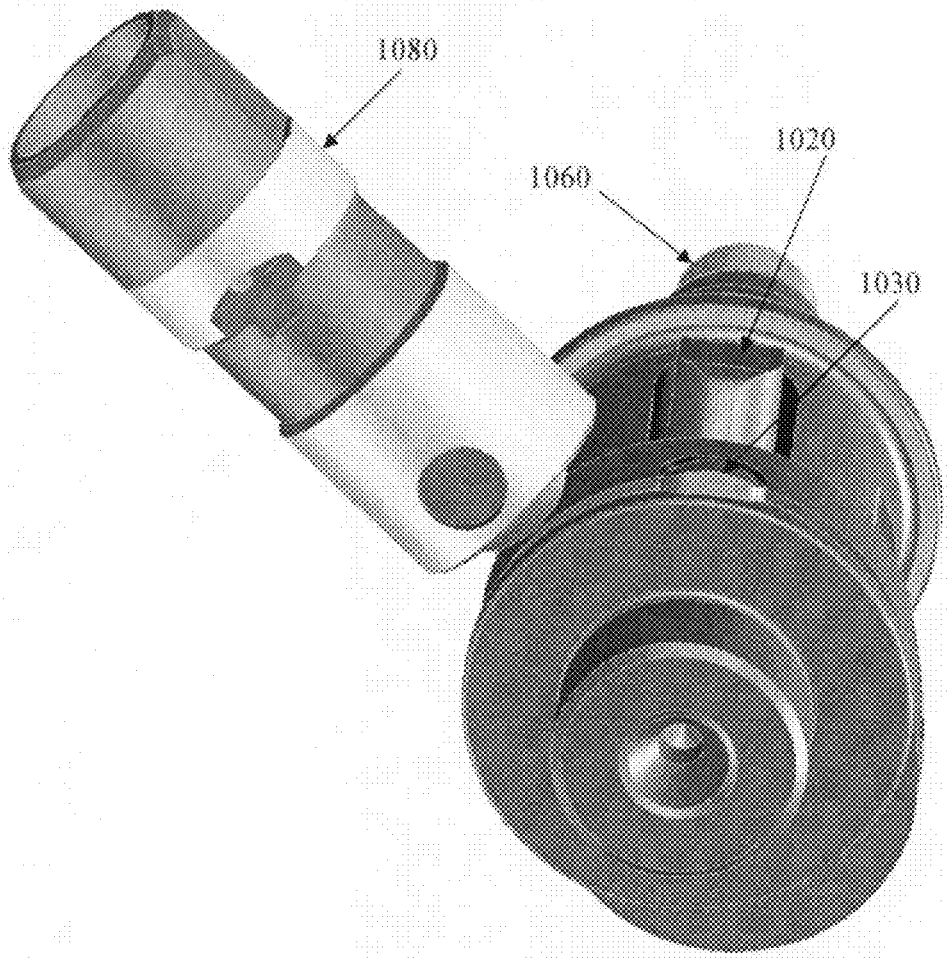
FIG. 23 depicts the camshaft, compression release mechanism, and lifter assembly of FIG. 22 rotated partially about a spring axis and partially about a camshaft axis.
Figure 24:
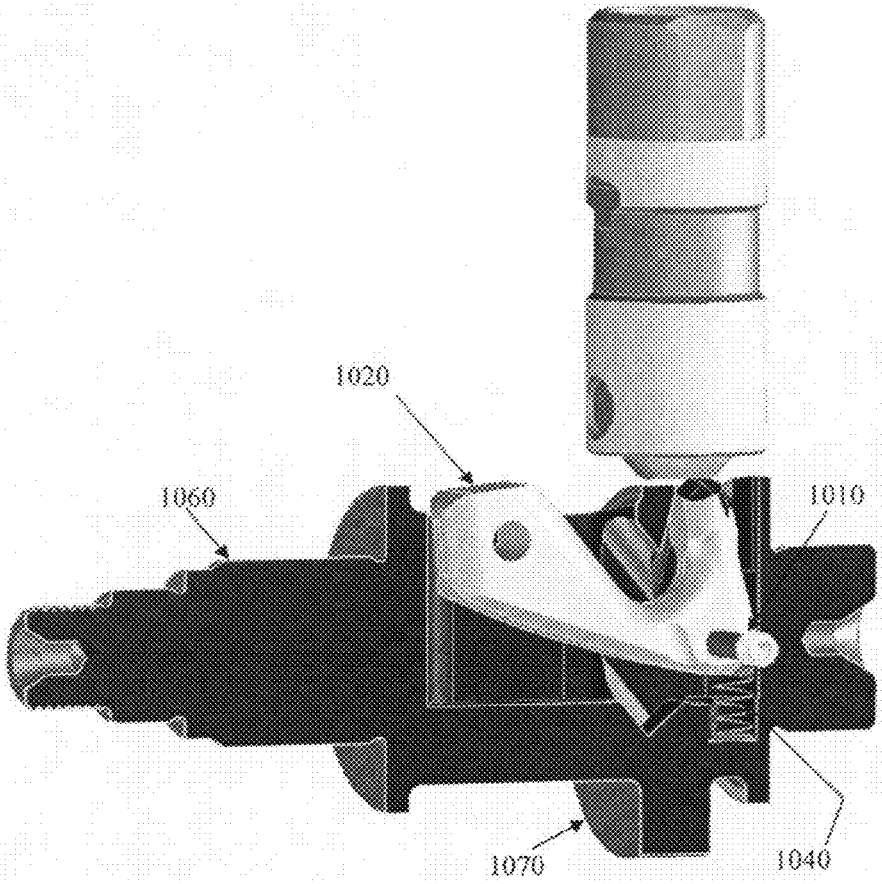
FIG. 24 depicts a cross sectional view of a camshaft with a trigger in an engagement position as may be used with a rear exhaust camshaft according to an embodiment of the present invention.
Figure 25:
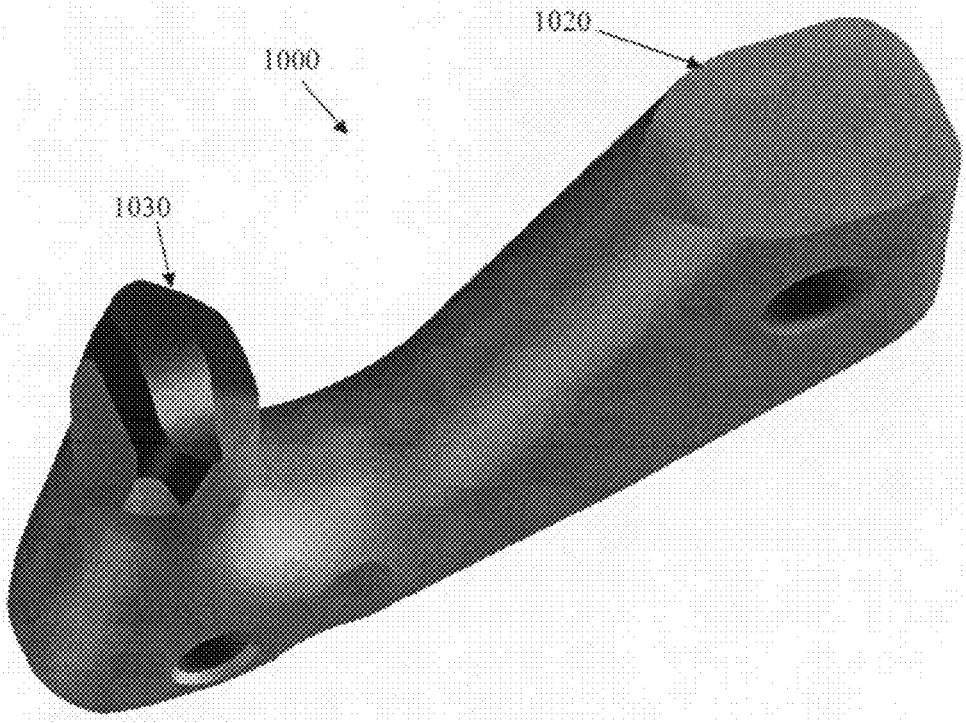
FIG. 25 is a perspective view of the trigger shown in FIG. 24.
Figure 26:
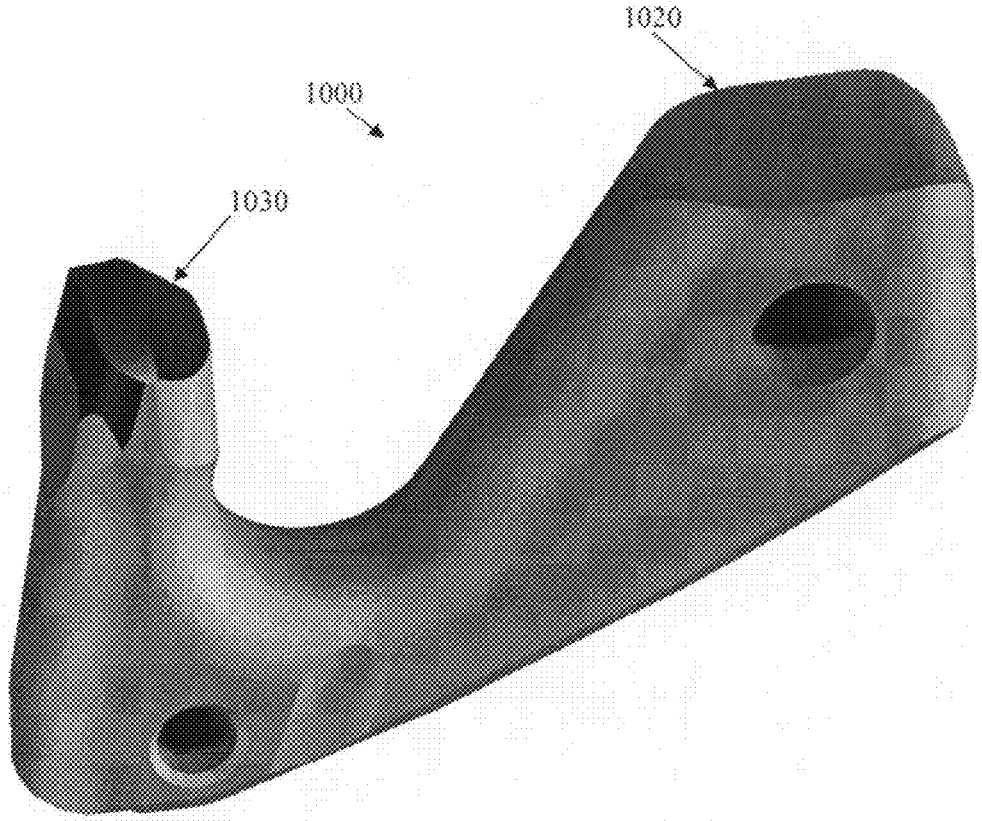
FIG. 26 is another perspective view of the trigger shown in FIG. 24.
Figure 27:
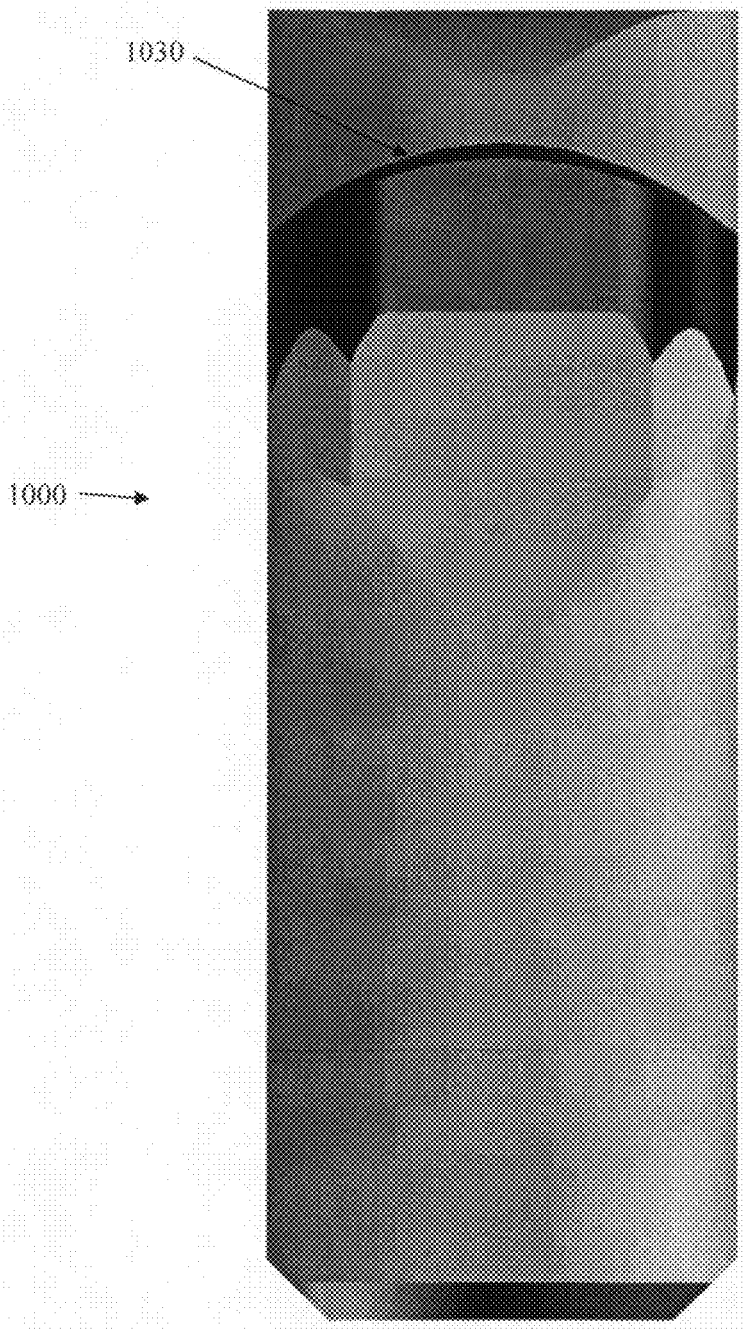
FIG. 27 is a front end view of the trigger shown in FIG. 24.
Figure 28:
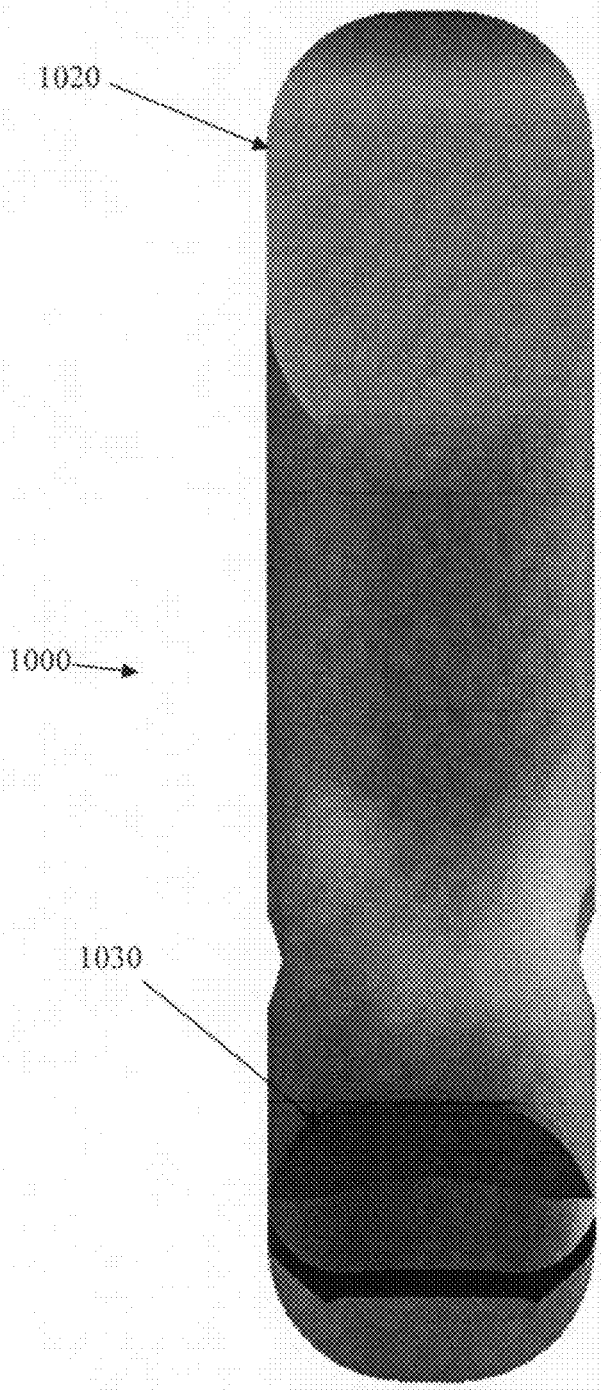
FIG. 28 is a top view of the trigger shown in FIG. 24.
Figure 29:
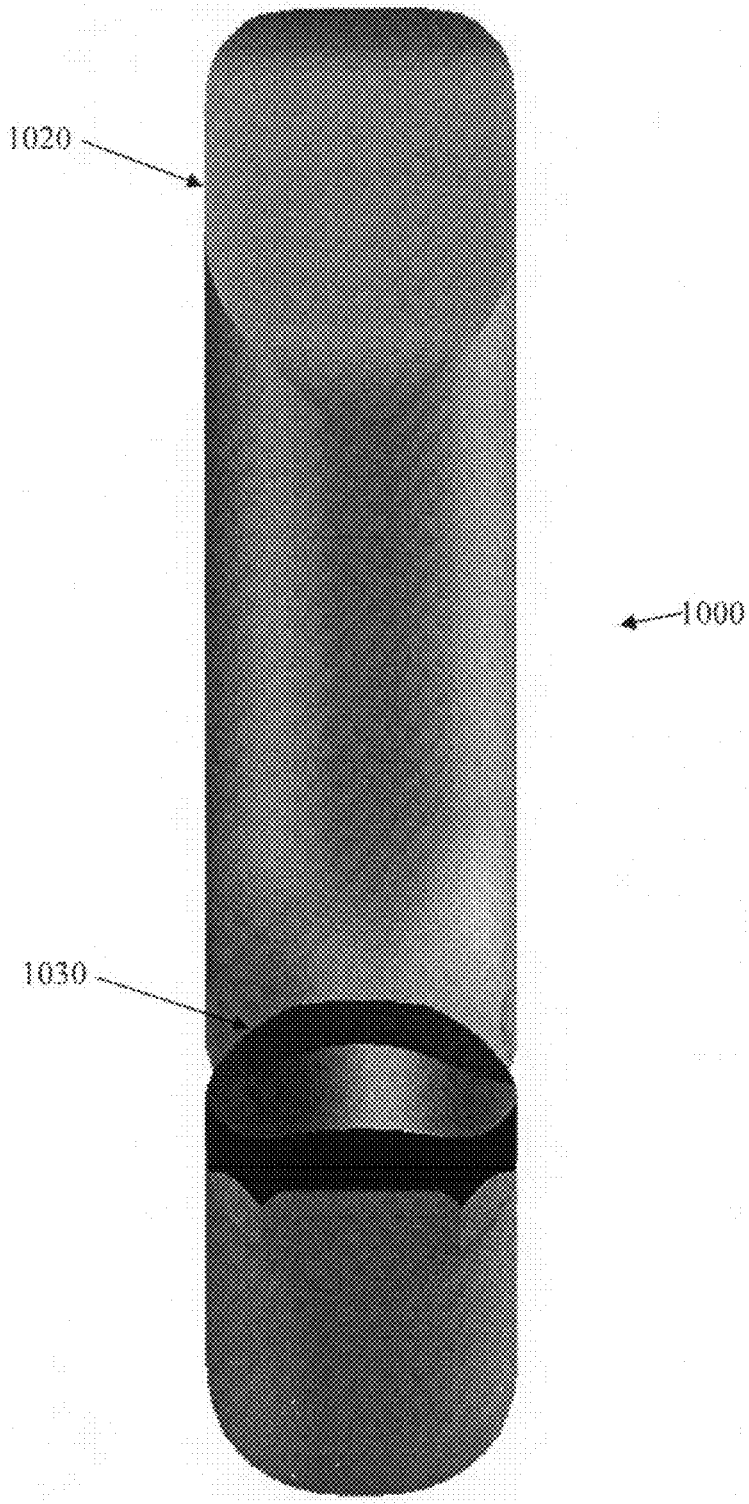
FIG. 29 is a top view of the trigger shown in FIG. 24.
Figure 30:
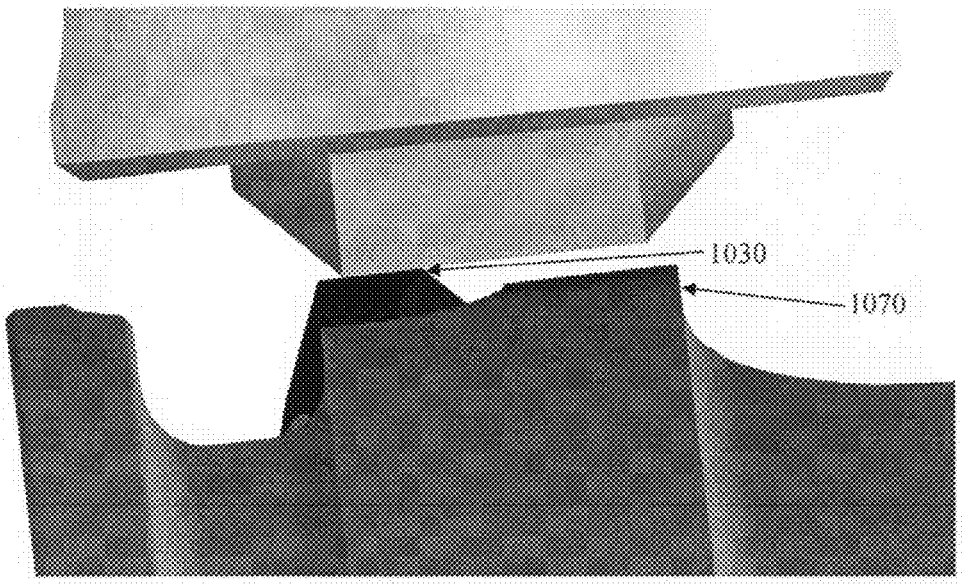
FIG. 30 is a close up view of contact between the trigger shown in FIG. 24 and a lifter assembly, and depicts an optional cut out/recessed portion of a camshaft lobe proximate to a compression release lobe.
Figure 31:
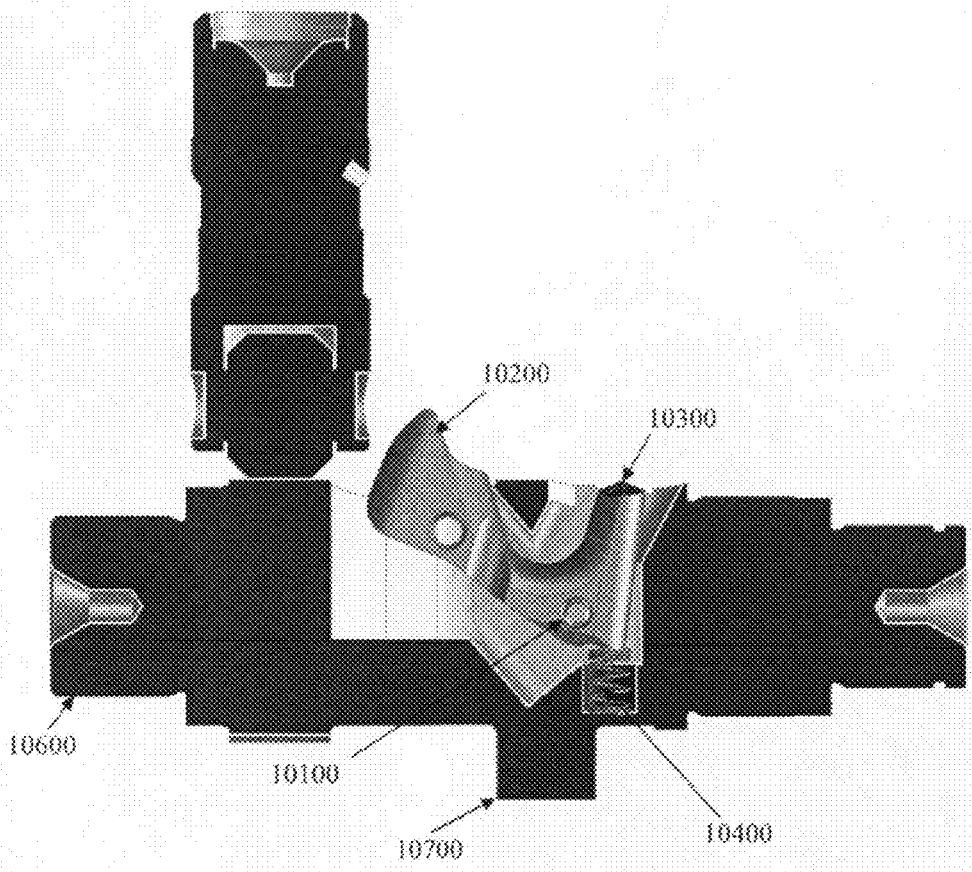
FIG. 31 is a cross sectional view of a compression release mechanism according to another embodiment of the present invention.
Figure 32:
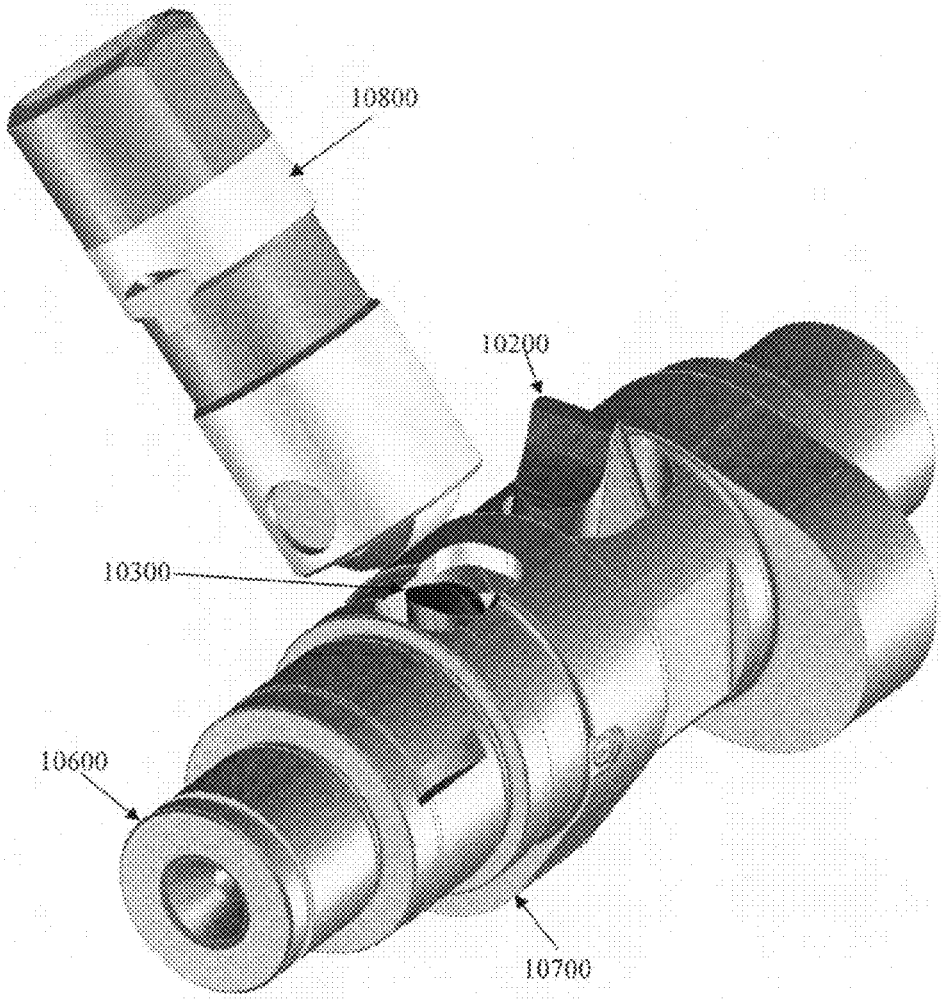
FIG. 32 is a perspective view of the compression release mechanism of FIG. 31, with the trigger in a disengagement position according to an embodiment of the present invention.

According to an embodiment of the present invention, the camshaft lobe 1070 includes a recess that receives the compression release lobe 1030 when the trigger 1000 is in the engagement position. As shown, for example, in FIG. 30, the recess may have a sufficient volume to permit direct contact between the roller of the lifter assembly 1080 and the lifter roller engagement surface of compression release lobe 1030. As shown in FIGS. 16 and 30, however, the recess may have a volume that only allows for part of the roller of the lifter assembly 1080 to directly contact the lifter roller engagement surface of compression release lobe 1030. Stated another way, when the lifter assembly 1080 is in contact with the trigger 1000, part of the lifter roller surface is in contact with the lifter roller engagement surface and another part of the lifter roller surface is free floating. This configuration allows the base circle to remain intact for normal engine operation, and the trigger 1000 to contact the lifter assembly during low engine speeds as described in greater detail below.

Because the compression release lobe 1030 of trigger 1000 protrudes from the camshaft base circle when in the engaged position, the compression release lobe 1030 contacts the lifter assembly 1080, 1090 traveling the camshaft base circle. Contact between the compression release lobe 1030 and the lifter assembly 1080, 1090 causes the lifter assembly 1080, 1090 to crack the associated valve open. For example, a lifter assembly 1080, 1090 for an exhaust valve may be contacted during the compression stroke to relieve a certain amount of cranking compression and thereby allow the engine to start easier. Preferably, when contact between the compression release lobe 1030 and the lifter assembly 1080, 1090 occurs, there is no contact between the lifter assembly 1080, 1090 and the camshaft lobe 1070.

It should be appreciated that the trigger 1000 is held in the engaged position at RPMs below a known value due to the use of a spring 1040 positioned between the trigger 1000 and the camshaft 1060 (or due to the presence of gravity, with or without assistance by spring 1040). Preferably, a compression spring 1040 is utilized with a known spring constant. Certain parameters of the compression spring 1040, such as the spring constant, can be adjusted for a given application at hand so as to correspondingly adjust the RPM at which a given trigger 1000 will rotate from an engaged position to a disengagement position and vice versa. Similarly, certain parameters of the trigger 1000 (e.g., the amount of mass and distribution thereof in counterweight 1020) can be adjusted for a given application at hand so as to correspondingly adjust the RPM at which the trigger 1000 will rotate from an engaged position to a disengagement position and vice versa. By way of example, an optional through hole 1025 may be provided in counterweight 1020 to reduce the associated mass or the center of gravity thereof. Through hole 1025 may also be used for manufacturing purposes.

Figure 33:
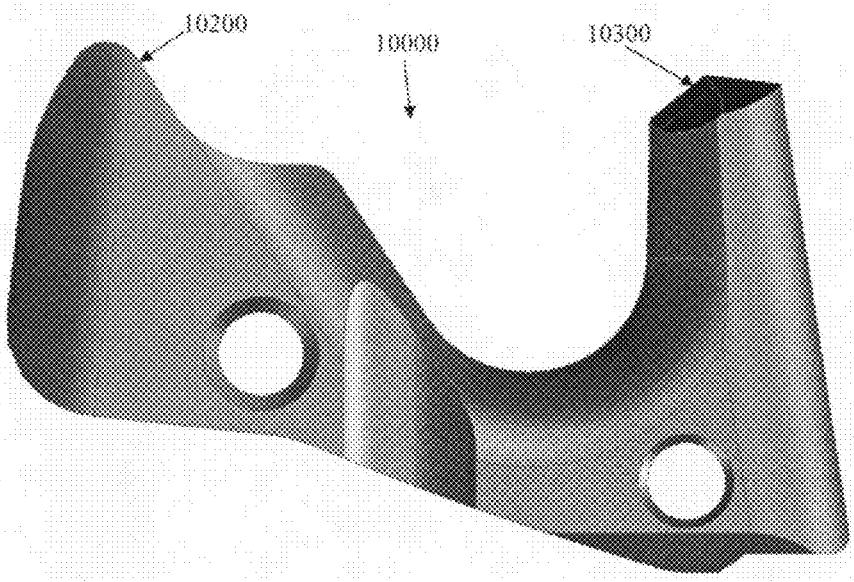
FIG. 33 is a side view of the trigger of the embodiment shown in FIG. 31.
Figure 34:
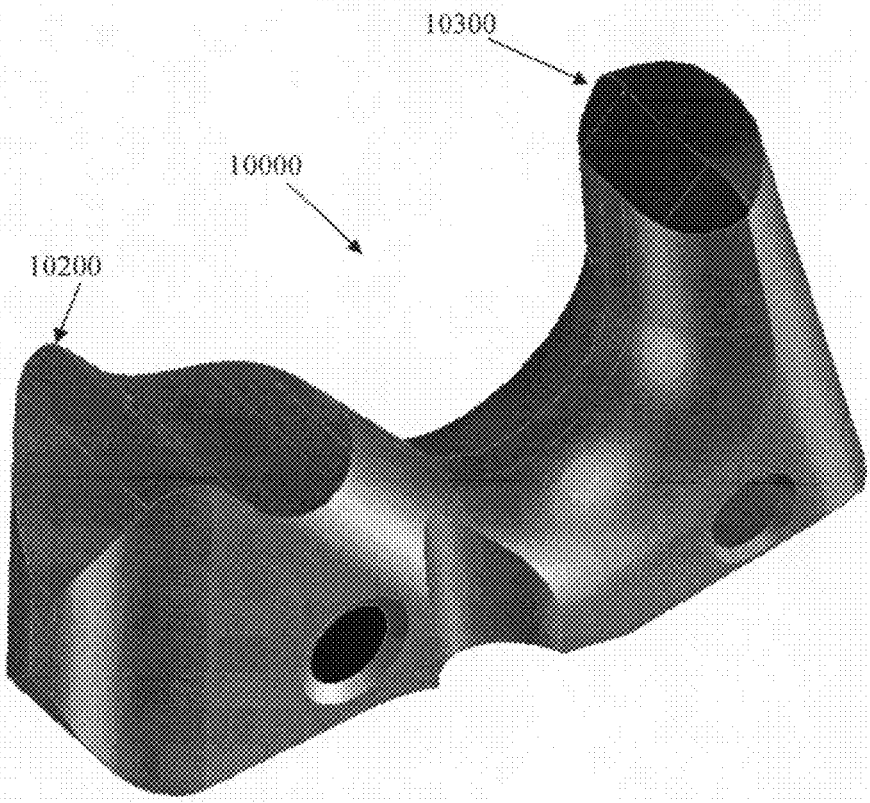
FIG. 34 is a perspective view of the trigger shown in FIG. 33.
Figure 35:
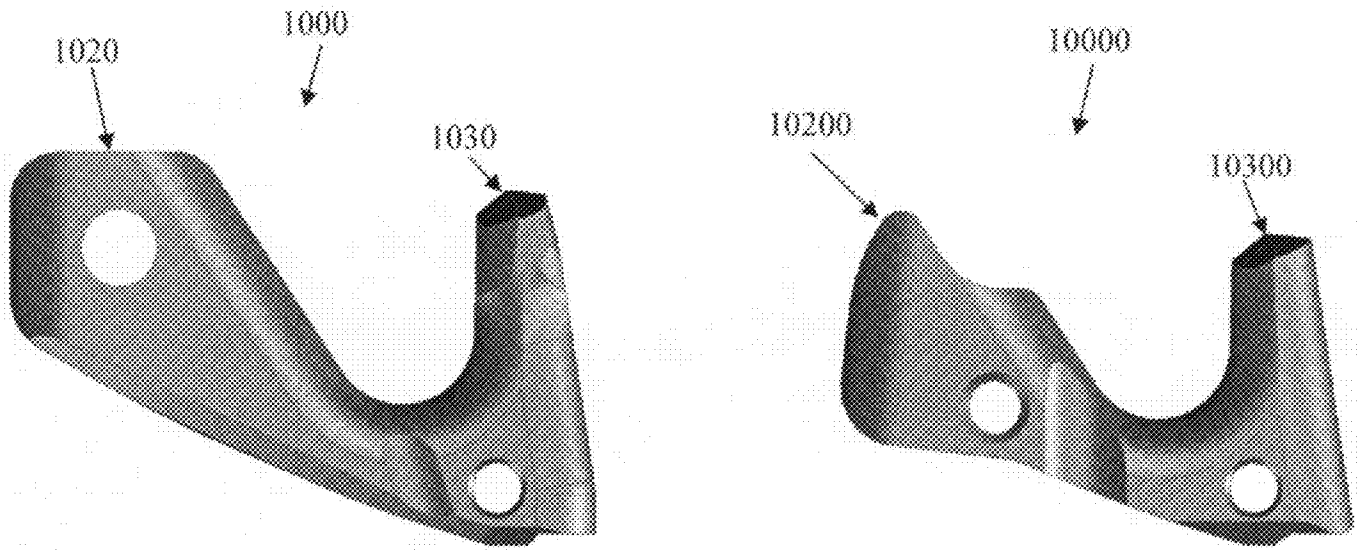
FIG. 35 is a side by side comparison of the trigger from the embodiment of FIG. 33 with the trigger from the embodiment of FIG. 24.
Figure 38:
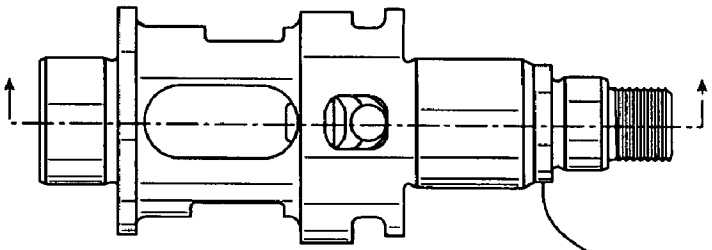
FIGS. 38 and 39 show the camshaft from the embodiment of FIG. 24, with FIG. 39 being the cross section of FIG. 38 along line F-F.
Figure 39:
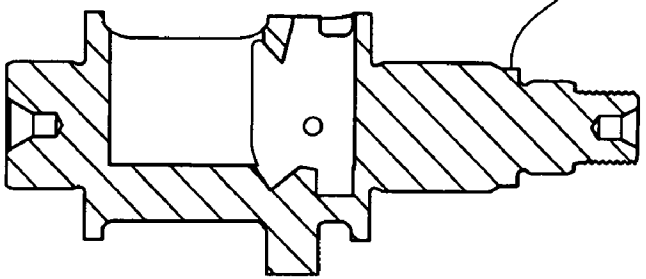
Figure 36:
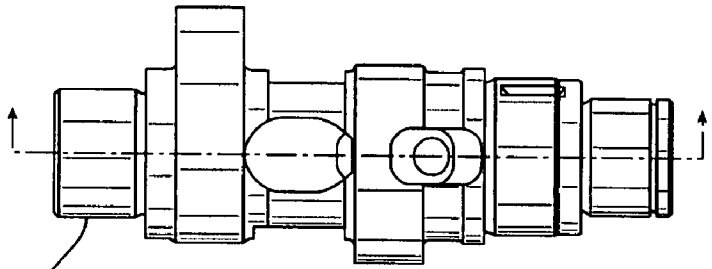
FIGS. 36 and 37 show the camshaft form the embodiment of FIG. 33, with FIG. 37 being a cross section of FIG. 36 along line A-A.
Figure 37:
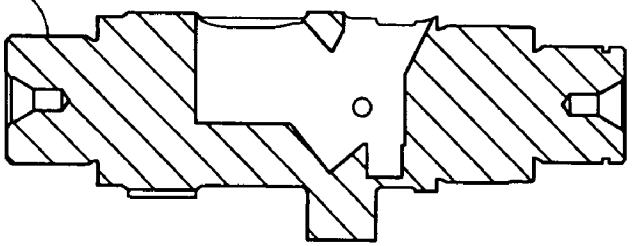

The modifiability of the compression release mechanism (and/or parameters thereof) described above is exemplified by the embodiments shown in FIGS. 31-34, comparison FIG. 35, and/or camshaft FIGS. 36-39. As shown, for example, in FIGS. 31-34, a compression release mechanism may be provided in camshaft 10600 (which includes camshaft lobe 10700) which actuates a lifter assembly 10800. The compression release mechanism shown includes a trigger 10000 with compression release lobe 10300 and counterweight 10200, a pin 10100 about which the trigger 10000 rotates, and a spring 10400 positioned between the camshaft 10600 and the trigger 10000. Operation of the compression release mechanism shown in FIGS. 31-34 is substantially similar to operation of the compression release mechanism(s) shown in FIGS. 8-30.

The compression release mechanism of FIGS. 31-34 differs from the compression release mechanism(s) of FIGS. 8-30, however, in several respects. In particular, the compression release mechanism of FIGS. 31-34 has been modified to accommodate a different engine family. As shown, for example, by comparing the camshaft 10600 of FIGS. 36 & 37 with the camshaft 1060 of FIGS. 38, 39, different lifter assembly orientations are accommodated by the profiles of the camshafts 1060 and 10600. Camshaft differences include, for example, a change in diameter of about 0.150", shallower counterweight pockets in camshaft 10600 due to smaller trigger counterweight 10200, simplification and enlargement of the angled pockets in camshaft 10600 to speed machining processes, and reorientation of the trigger counterweight 10200 to between camshaft lobes.

Corresponding trigger 1000, 10000 differences can also be observed by referencing the side by side comparison in FIG. 35. As shown, the trigger 10000 includes a shorter nose part than trigger 1000 to accommodate the smaller camshaft diameter. Further, counterweight 10200 is shortened and given a modified shape to provide for lifter clearance due to the presence of two lifter assemblies operating on the same camshaft 10600. Further, the counterweight through hole in trigger 10000 is decreased in diameter and moved so as to maximize the mass and movement of the counterweight 10200. As shown in FIGS. 33 and 34, machining around the nose of lobe 10300 was simplified and/or eliminated to reduce machining time. Other variations may also exist as would be readily understood by those of skill in the art after reading this disclosure.

Figure 40:
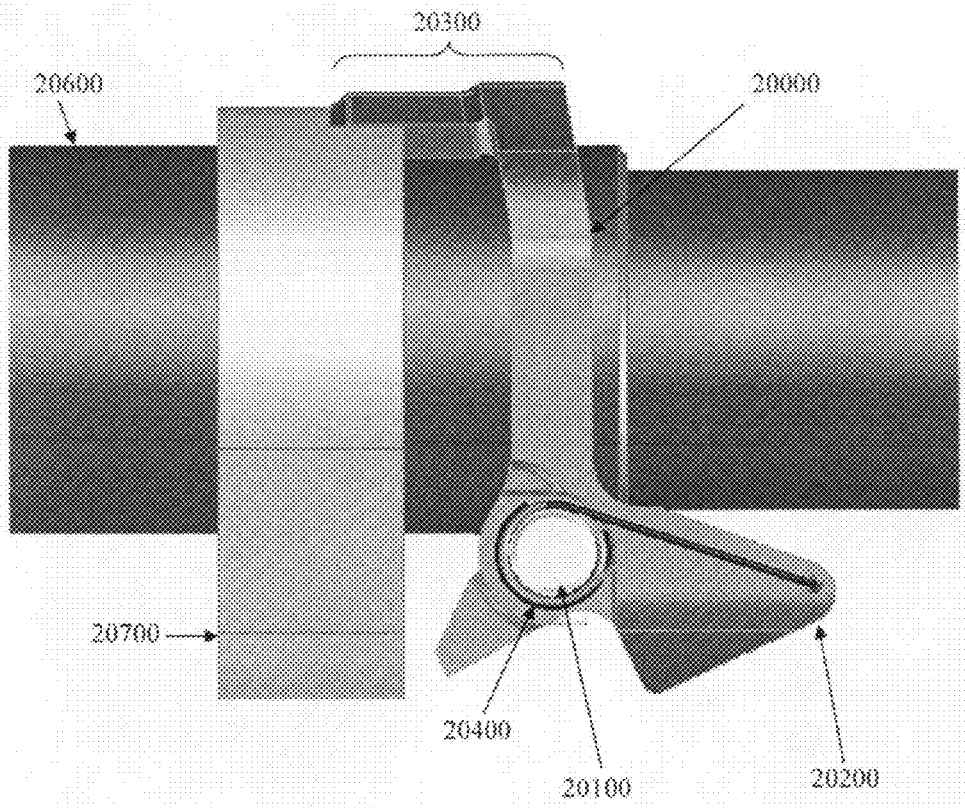
FIG. 40 depicts a side view of a compression release mechanism with a trigger in an engagement position according to an embodiment of the present invention.
Figure 41:
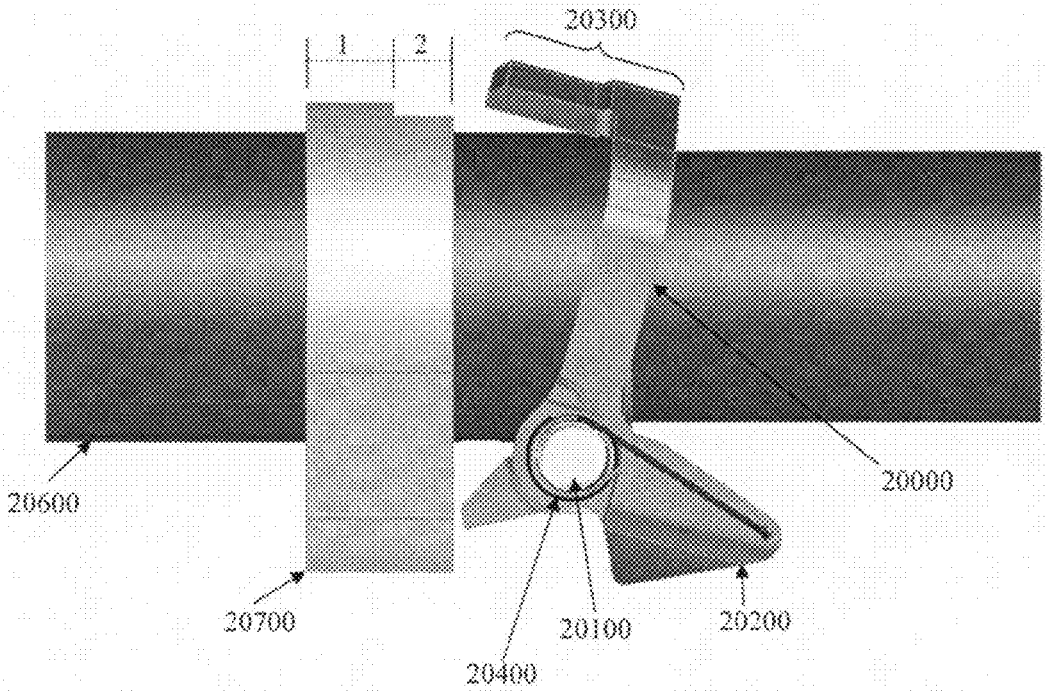
FIG. 41 depicts a side view of the compression release mechanism of FIG. 40 with the trigger in a disengagement position according to an embodiment of the present invention.
Figure 42:
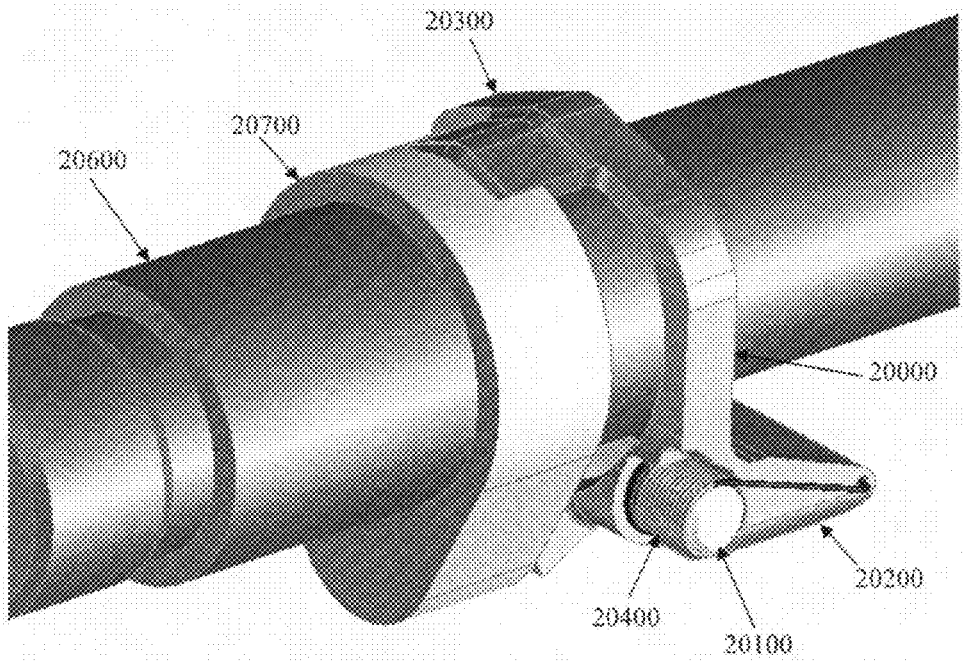
FIG. 42 is a perspective view of the embodiment shown in FIG. 40.

A compression release mechanism and associated camshaft 20600 according to yet another embodiment of the present invention is shown in FIGS. 40-42. The compression release mechanism includes a ring 20000 which rotates about a pin 20100 operably connected to camshaft 20600. The ring 20000 includes a decompression lobe 20300 and a counterweight 20200. A spring 20400, such as a coil spring, is operably attached to pin 20100 and counterweight 20200.

Operation of the compression release mechanism shown in FIGS. 40-42 is analogous in at least some respects to operation of the compression release mechanisms shown in FIGS. 8-39. In particular, at low RPMs (e.g., during engine cranking), the spring 20400 applies a relative force between ring 20000 and camshaft 20600 so as to hold the release in an engagement position (FIG. 40). Once the camshaft 20600 achieves or exceeds a certain rotational velocity, centripetal forces acting on counterweight 20200 overcome the force of the spring 20400 thereby causing ring 20000 to rotate from the engagement position shown in FIGS. 40 and 42 to the disengagement position shown in FIG. 41. A lifter assembly (not shown) traveling along camshaft lobe 20700 will thus contact lobe 20300 when ring 20000 is in the engagement position, and will avoid contact with lobe 20300 when ring 20000 is in the disengagement position.

It should be appreciated that camshaft lobe 20700 of camshaft 20600 may include a periphery so as to accommodate lobe 20300 of ring 20000. As shown, for example, in FIG. 41, a region 2 of the camshaft lobe periphery is recessed relative to region 1 of the camshaft lobe periphery. Region 1 includes a width corresponding to the engagement portion of lobe 20300 as shown, for example, in FIGS. 40 and 42. Other configurations are also contemplated.

Figure 43:
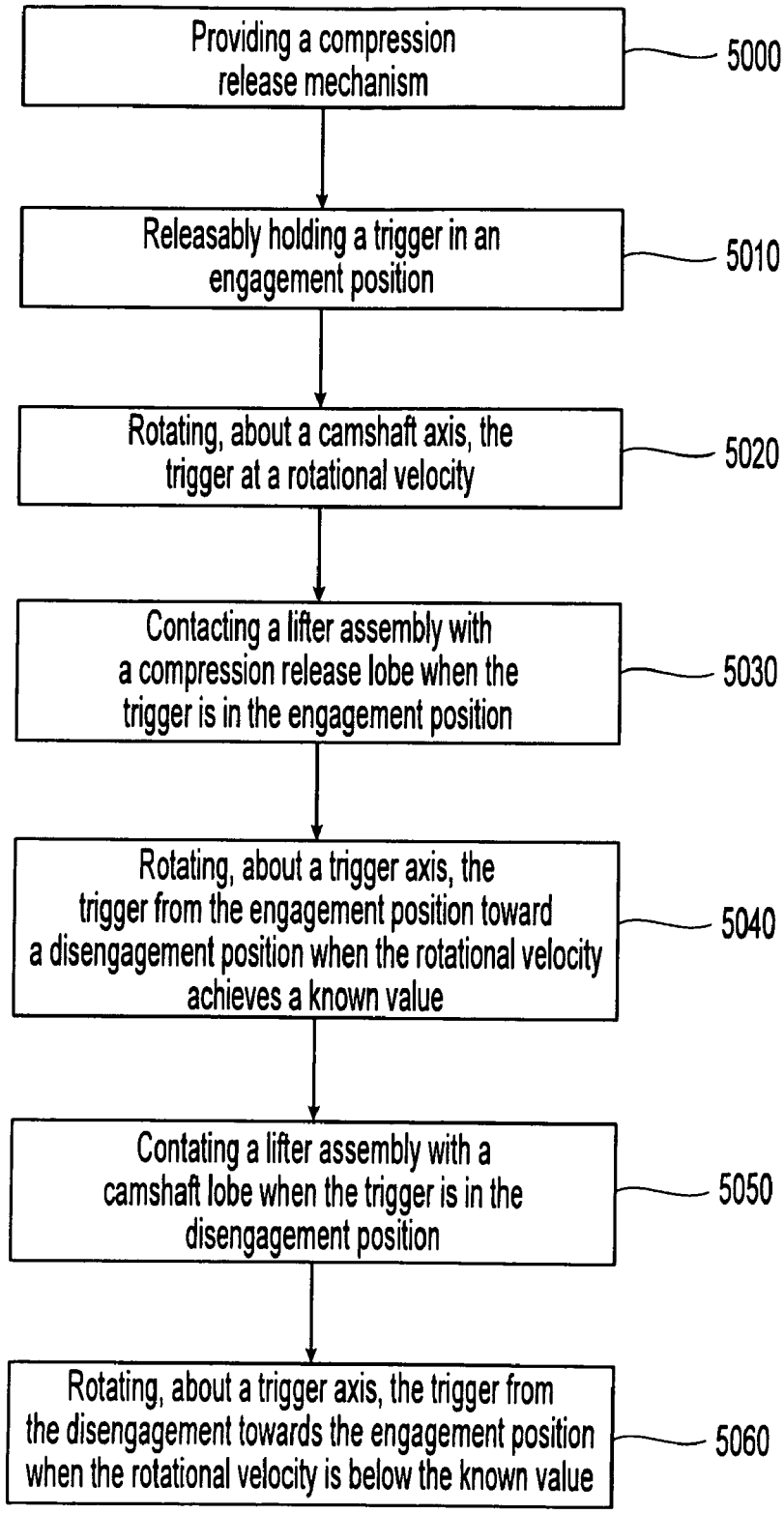
FIG. 43 is a flowchart of a method of selectably releasing compression in an engine according to an embodiment of the present invention.

Referring now to the flowchart of FIG. 43, a method of selectably releasing compression in an engine is shown. In step 5000, a compression release mechanism is provided with an internal combustion engine. For example, step 5000 may comprise providing the compression release mechanism of the embodiments shown in FIGS. 8-30 with an OEM twin cylinder motorcycle engine or retrofitting a twin cylinder motorcycle engine to include such a compression release mechanism. In step 5010, a trigger of the compression release mechanism is held in an engagement position, e.g., by way of a spring. Preferably step 5010 is performed at least while the engine is turned off and while the engine is operating at RPMs below a known value.

In step 5020, the trigger is rotated about a camshaft axis at a rotational velocity. Step 5020 may be initiated, for example, by a starter motor or kick starter of a motorcycle engine which causes the engine to turn over at a relatively low RPM. While operating at the relatively low RPM (e.g., at camshaft RPMs below about three hundred and fifty RPMs or crankshaft RPMs below about seven hundred RPMs), the trigger remains held in the engagement position and a lifter assembly in the engine comes into contact in step 5030 with a compression release lobe of the trigger. It should be appreciated that "contact" in step 5030 refers to the periodic contact once per revolution of the compression release lobe with the lifter assembly. Contact in step 5030 with the lifter assembly causes an associated valve to open slightly, thereby releasing pressure in cylinder and allowing the engine to start more easily.

Once the rotational velocity of the crankshaft achieves a known value (e.g., at about engine idle or slightly below engine idle), the trigger is rotated about a trigger axis in step 5040 from the engagement position toward a disengagement position. By way of example, step 5040 can be performed by rotating a trigger from the orientation shown in FIG. 11 to the orientation shown in FIG. 12, or from the orientation shown in FIG. 13 to the orientation shown in FIG. 14. In order to reduce the possibility of the trigger being partially engaged when the trigger is in transition (e.g., from an engagement position to a disengagement position or vice versa), a profile of the trigger (e.g., of the compression release lobe 1030 shown in FIGS. 25-30) can be designed to include an arced surface and/or beveled edges.

While the trigger is oriented in the disengagement position, the lifter assembly preferably contacts in step 5050 only the camshaft lobe and not any portion of the trigger. To facilitate this functionality, the trigger may be positioned within the camshaft in the disengagement position such that a leading surface is at or below a leading surface of an associated camshaft lobe. Alternatively, a leading surface of the trigger may project beyond a leading surface of an associated camshaft lobe provided the trigger be positioned wholly outside the lifter assembly path of travel.

When the rotational velocity of the camshaft falls below the known value, such as during engine shutdown, the trigger is rotated in step 5060 from the disengagement position toward the engagement position. By way of example, step 5060 can be performed by rotating a trigger from the orientation shown in FIG. 12 to the orientation shown in FIG. 11, or from the orientation shown in FIG. 14 to the orientation shown in FIG. 13.

As illustrated by the embodiments above, the present invention can be used in a wide variety of applications. It should be appreciated that various parameters, such as spring constants, counterweight mass, counterweight center of mass, etc. may be adjusted for a particular application at hand. By way of example, one or more of the aforementioned embodiments can be used so as to operate in an engagement position at RPMs below an RPM in a range of about six hundred and twenty five crankshaft RPMs to about seven hundred and twenty five crankshaft RPMs, or about half that for camshaft RPMs. More preferably, one or more of the aforementioned embodiments can be used so as to operate in an engagement position at RPMs below about seven hundred crankshaft RPMs or about three hundred and fifty camshaft RPMs. Other possibilities are also contemplated.

The foregoing description of various embodiments of the present invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

What is claimed is:

1. A compression release assembly comprising:

a camshaft rotatable about a camshaft axis and including a camshaft lobe;

a trigger rotatably mounted on the camshaft about a trigger axis, the trigger axis being substantially perpendicular to the camshaft axis and intersecting the trigger between first and second distal ends of the trigger, the trigger including a compression release lobe formed at the first distal end of the trigger proximate to the camshaft lobe; and a counterweight formed at the second distal end of the trigger, the trigger being L shaped and positioning the first and second distal ends on a same side of the camshaft axis; and a spring positioned between the camshaft and the trigger, the spring tending to rotate the trigger about the trigger axis toward an engagement position, wherein when the camshaft is rotating at or above a sufficient velocity, centripetal forces acting on the counterweight overcome spring biasing such that the trigger rotates from the engagement position to a disengagement position.

2. The assembly of claim 1, wherein the sufficient velocity is in a range of about 625 revolutions per minute and about 725 revolutions per minute.

3. The assembly of claim 2, wherein the sufficient velocity is about 700 revolutions per minute.

4. The assembly of claim 1, further comprising:

a pin extending along the trigger axis, the pin rotatably coupling the trigger to the camshaft.

5. The assembly of claim 1, wherein the spring has a spring axis substantially perpendicular to the camshaft axis.

6. The assembly of claim 5, wherein the spring axis is substantially perpendicular to the trigger axis.

7. The assembly of claim 1, wherein the spring has a spring axis substantially parallel to the camshaft axis.

8. The assembly of claim 7, wherein the spring axis is substantially perpendicular to the trigger axis.

9. The assembly of claim 1, wherein the spring comprises a compression spring.

10. The assembly of claim 1, wherein the trigger is oriented relative to the camshaft such that the compression release lobe is positioned in a lifter roller path of travel when the trigger is in the engagement position.

11. The assembly of claim 10, wherein the compression release lobe comprises a lifter roller engagement surface arced between a first end and a second end, both the first end and the second end being at a same distance from the trigger axis.

12. The assembly of claim 11, wherein the trigger is oriented relative to the camshaft such that the lifter roller engagement surface arcs about the camshaft axis when the trigger is in the engagement position.

13. The assembly of claim 11, wherein the compression release lobe includes beveled edges extending along at least a portion of the lifter roller engagement surface.

14. The assembly of claim 11, wherein the camshaft lobe includes a recess, and wherein the recess receives the compression release lobe when the trigger is in the engagement position, and wherein the recess is of sufficient volume to permit direct contact between the lifter roller engagement surface and a lifter roller.

15. The assembly of claim 1, wherein the trigger includes a through hole proximate to the counterweight.

16. An apparatus comprising:

an engine including a camshaft rotatable about a camshaft axis and including a camshaft lobe; and a compression release assembly including a trigger rotatably mounted on the camshaft about a trigger axis, the trigger axis being substantially perpendicular to the camshaft axis and intersecting the trigger between first and second distal ends of the trigger, the trigger including a compression release lobe formed at the first distal end of the trigger proximate to the camshaft lobe; and a counterweight formed at the second distal end of the trigger, the trigger being L shaped and positioning the first and second distal ends on a same side of the camshaft axis; and a spring positioned between the camshaft and the trigger, the spring tending to rotate the trigger about the trigger axis toward an engagement position, wherein when the camshaft is rotating at or above a sufficient velocity, centripetal forces acting on the counterweight overcome spring biasing such that the trigger rotates from the engagement position to a disengagement position.

17. The apparatus of claim 16, including a vehicle frame with the engine mounted thereon.

18. The apparatus of claim 17, including two wheels on the vehicle frame to thus form a motorcycle.

19. A method of selectably releasing compression in an engine, comprising:

providing a camshaft defining a camshaft axis;

releasably holding a trigger in an engagement position with a spring, the trigger including a compression release lobe formed at a first distal end of the trigger and a counterweight formed at a second distal end of the trigger and a trigger axis defining with the first and second distal ends an L shaped arrangement so that the first and second ends are on a same side of the camshaft axis when assembled to the camshaft;

contacting a compression release lobe of the trigger with a lifter when the trigger is in the engagement position;

rotating, about the camshaft axis, the trigger at a rotational velocity;

rotating, about the trigger axis perpendicular to the camshaft axis, the trigger from the engagement position toward a disengagement position when the rotational velocity achieves a known value;

contacting a camshaft lobe with the lifter when the trigger is in the disengagement position; and rotating, about the trigger axis, the trigger from the disengagement position toward the engagement position when the rotational velocity is below the known value.

20. A compression release assembly comprising:

means for selectably contacting a compression release lobe of a trigger with a lifter;

means for rotating, about a trigger axis perpendicular to a camshaft axis, the trigger from an engagement position toward a disengagement position when a rotational velocity of a camshaft achieves a known value, the trigger being L shaped and including first and second distal ends on a same side of the camshaft axis; and means for rotating, about the trigger axis, the trigger from the disengagement position toward the engagement position when the rotational velocity of the camshaft is below the known value.

21. A compression release assembly comprising:

a camshaft rotatable about a camshaft axis and including a camshaft lobe and opposing outwardly-facing flat engagement surfaces;

a ring defining an opening with inward-facing mating engagement surfaces slidably engaging the flat engagement surfaces for mounting the ring on the camshaft and including a counterweight formed at a first distal end of the ring; and a compression release lobe formed at a second distal end of the ring; and a spring positioned between the camshaft and the ring, the spring tending to slide the ring relative to the camshaft into an engagement position, wherein when the camshaft is rotating at or above a sufficient velocity, centripetal forces acting on the counterweight overcome spring biasing such that the ring slides from the engagement position to a disengagement position.

22. The assembly of claim 21, wherein the ring further includes an engagement surface, and wherein contact between a lifter assembly and the compression release lobe while in the engagement position causes the engagement surface to engage a corresponding surface on the camshaft so as to lock the ring in place relative to the camshaft.

23. A compression release assembly comprising:

a camshaft rotatable about a camshaft axis and including a camshaft lobe and a trigger-receiving recess not extending through the camshaft;

a trigger rotatably mounted on the camshaft about a trigger axis, the trigger axis being substantially perpendicular to the camshaft axis and intersecting the trigger between first and second distal ends of the trigger, the trigger including a compression release lobe formed at the first distal end of the trigger proximate to the camshaft lobe; and a counterweight formed at the second distal end of the trigger; and a spring positioned between the camshaft and the trigger, the spring tending to rotate the trigger about the trigger axis toward an engagement position, wherein when the camshaft is rotating at or above a sufficient velocity, centripetal forces acting on the counterweight overcome spring biasing such that the trigger rotates from the engagement position to a disengagement position.

* * * * *